US009365070B2

(12) United States Patent
Hirahara

(10) Patent No.: US 9,365,070 B2
(45) Date of Patent: Jun. 14, 2016

(54) FILE BINDER, PRINTED MATTER SET, AND PRINTED MATTER

(71) Applicant: CALENDAR KOKOKU CO., LTD., Osaka-shi, Osaka (JP)

(72) Inventor: Yutaka Hirahara, Osaka (JP)

(73) Assignee: CALENDAR KOKOKU CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 14/762,204

(22) PCT Filed: Dec. 26, 2013

(86) PCT No.: PCT/JP2013/084790

§ 371 (c)(1),
(2) Date: Jul. 21, 2015

(87) PCT Pub. No.: WO2014/122870

PCT Pub. Date: Aug. 14, 2014

(65) Prior Publication Data

US 2015/0375556 A1 Dec. 31, 2015

(30) Foreign Application Priority Data

Feb. 9, 2013 (JP) ..... 2013-023912
Jun. 17, 2013 (JP) ..... 2013-126285

(51) Int. Cl.
*B42F 13/12* (2006.01)
*B42F 13/14* (2006.01)
(Continued)

(52) U.S. Cl.
CPC *B42D 5/046* (2013.01); *B42D 5/04* (2013.01); *B42D 5/041* (2013.01); *B42D 5/06* (2013.01);
(Continued)

(58) Field of Classification Search
CPC ..... B42F 13/14; B42F 13/12; B42D 5/041; B42D 5/046; B42D 5/008
USPC ..... 281/44; 24/67.1, 67.3, 67.11, 67 P
See application file for complete search history.

(56) References Cited

U.S. PATENT DOCUMENTS 1,496,629 A * 6/1924 Helprin ..... B42F 9/00 24/67.3
2,051,551 A * 8/1936 Evans ..... B42F 9/00 281/45

(Continued)

FOREIGN PATENT DOCUMENTS

CH 258859 A * 12/1948 ..... B42D 5/041
DE 2948473 A1 * 6/1981 ..... B42D 5/041

(Continued)

OTHER PUBLICATIONS

International Search Report for PCT/JP2013/084790 dated Feb. 10, 2014.

(Continued)

*Primary Examiner* — Kyle Grabowski
(74) *Attorney, Agent, or Firm* — Yokoi & Co., U.S.A.; Toshiyuki Yokoi

(57) ABSTRACT

A file binder 103 has a back side plate member 2, a projecting member 3, and a front side plate member 6. A lower end part 5 of the back side plate member 2 is bent forward. The projecting member 3 projects forward from a part of the back side plate member 2 higher than the lower end part 5. The front side plate member 6 extends downward from a front end part of the projecting member 3 beyond a front end edge 80 of the lower end part 5, and forms a gap 81 from the front end edge 80. Pillar shape protruding portions 15 protrude backward from the front side plate member 6 under a lowermost end of the back side plate member 2, and beyond the front end edge 80, and reach the substantially same plane as a back surface of a main body part 4 of the back side plate member 2.

9 Claims, 14 Drawing Sheets

(51) Int. Cl.

| | |
|---|---|
| ***B42D 5/04*** | (2006.01) |
| ***B42D 5/06*** | (2006.01) |
| ***B42F 1/02*** | (2006.01) |
| ***B42F 9/00*** | (2006.01) |
| ***B42F 15/00*** | (2006.01) |
| ***B42F 1/00*** | (2006.01) |
| ***B42F 3/04*** | (2006.01) |

(52) U.S. Cl.
CPC . *B42F 1/006* (2013.01); *B42F 1/02* (2013.01); *B42F 3/04* (2013.01); *B42F 9/00* (2013.01); *B42F 13/12* (2013.01); *B42F 13/14* (2013.01); *B42F 15/00* (2013.01)

(56) References Cited

U.S. PATENT DOCUMENTS

| | | | | | |
|---|---|---|---|---|---|
| 3,947,138 | A * | 3/1976 | Eshelman | B42F 9/00 | 24/67.3 |
| 4,623,169 | A * | 11/1986 | Hutten | B42D 5/005 | 24/67.3 |
| 2011/0101669 | A1 * | 5/2011 | Taylor | B42D 5/005 | 281/44 |
| 2013/0026330 | A1 * | 1/2013 | Wilder | B42D 5/046 | 248/488 |

FOREIGN PATENT DOCUMENTS

| | | | | |
|---|---|---|---|---|
| GB | 298445 | A * | 10/1928 | B42F 13/00 |
| JP | S50-018354 | U | 2/1975 | |
| JP | S52-071753 | U | 5/1977 | |
| JP | S53-101818 | U | 8/1978 | |
| JP | S53-111822 | U | 9/1978 | |
| JP | H08-318687 | A | 12/1996 | |
| JP | H09-058151 | A | 3/1997 | |
| JP | H11-129646 | A | 5/1999 | |
| JP | 2000-006549 | A | 1/2000 | |
| JP | 2008-105183 | A | 5/2008 | |
| JP | 4709940 | B | 3/2011 | |
| JP | 4763844 | B | 6/2011 | |
| JP | 4913253 | B | 1/2012 | |
| JP | 5021059 | B | 6/2012 | |
| JP | 2013-010186 | A | 1/2013 | |

OTHER PUBLICATIONS

PCT written openion dated Feb. 10, 2014.

* cited by examiner

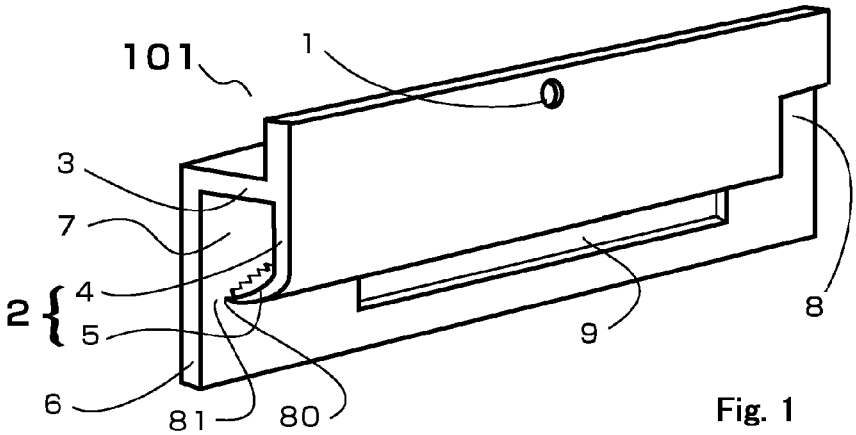
Fig. 1
Fig. 2B
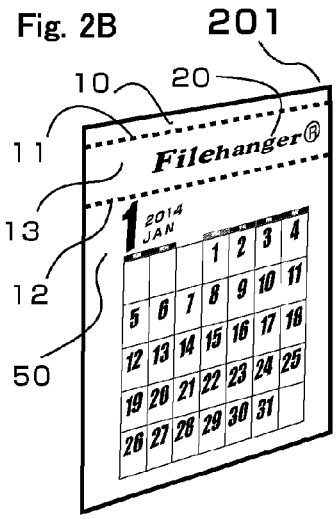
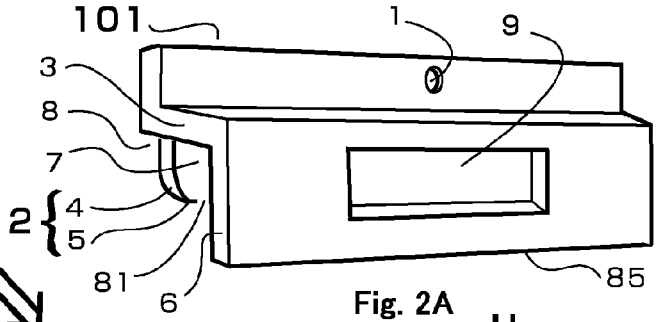
Fig. 2A
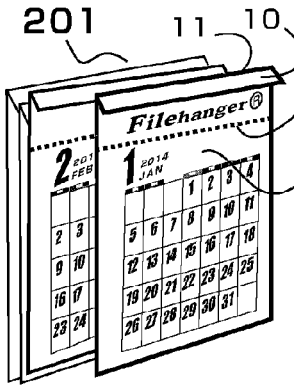
Fig. 2C
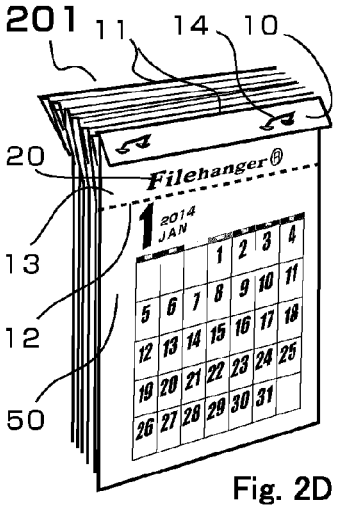
Fig. 2D
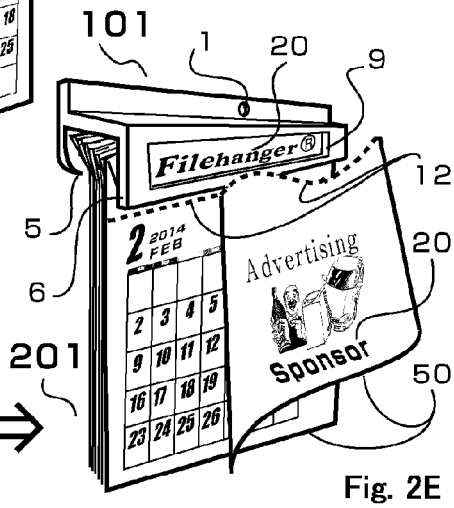
Fig. 2E

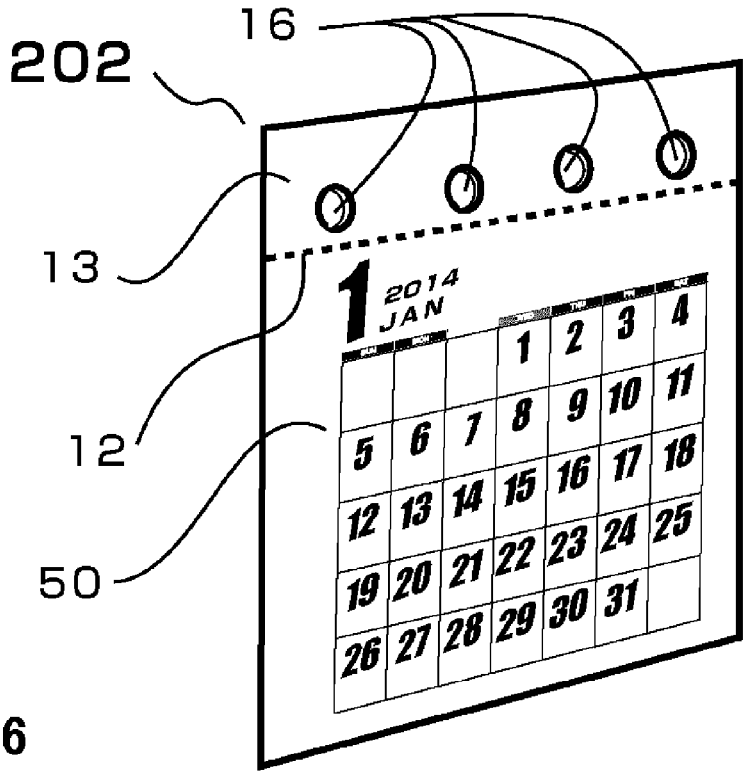
Fig. 6
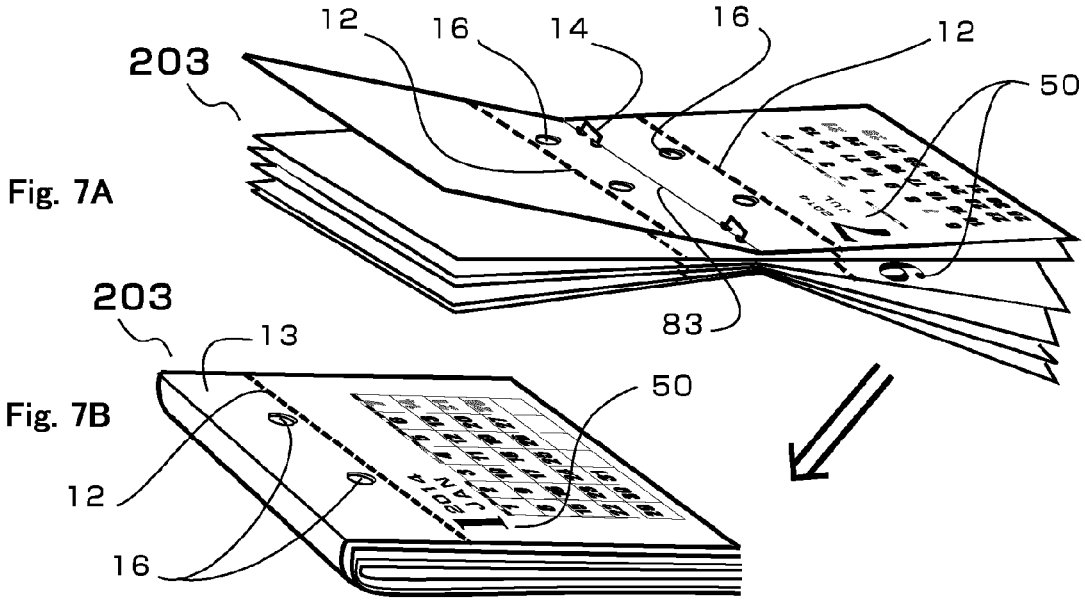
Fig. 7A
Fig. 7B

Fig. 8A
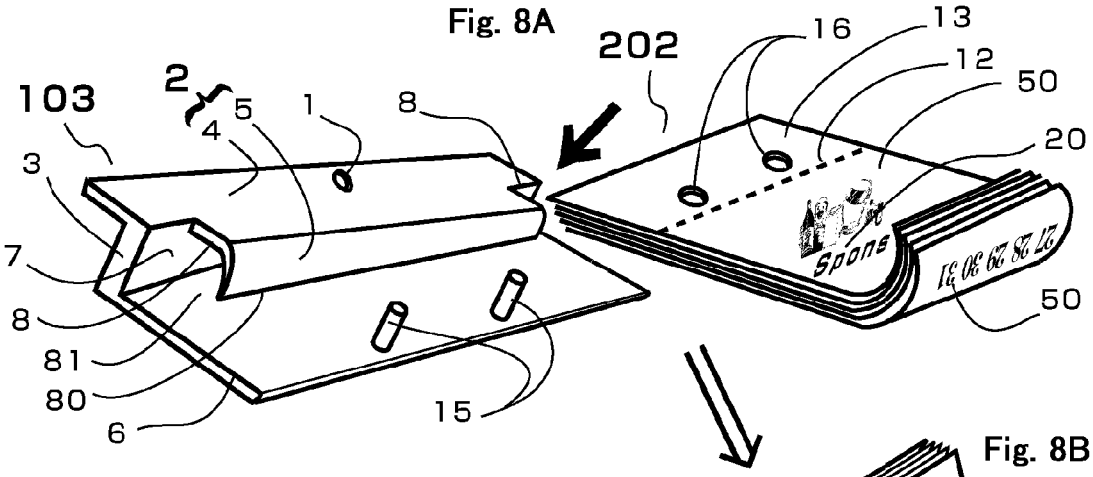
Fig. 8B
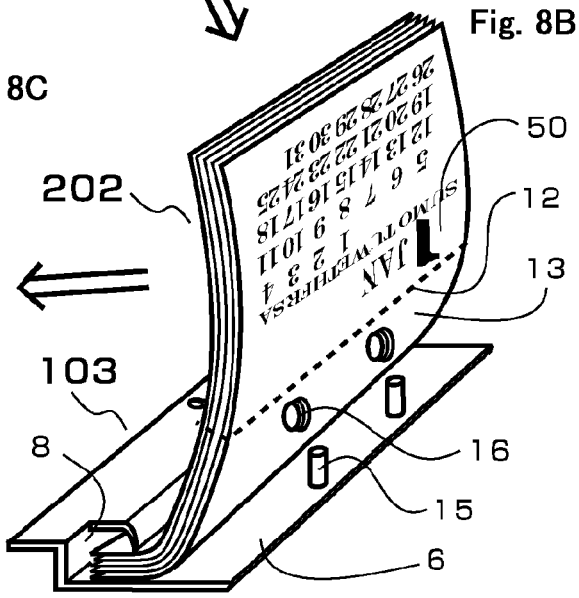
Fig. 8C
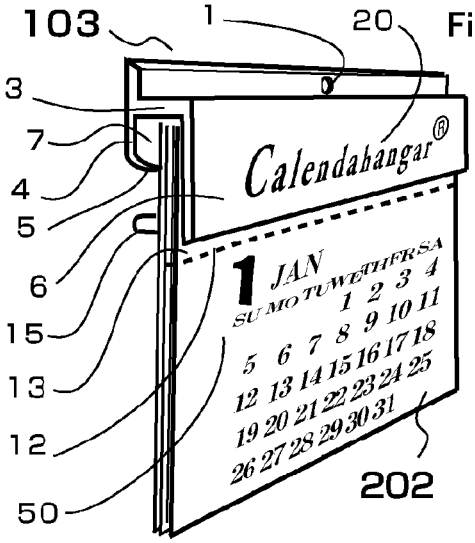
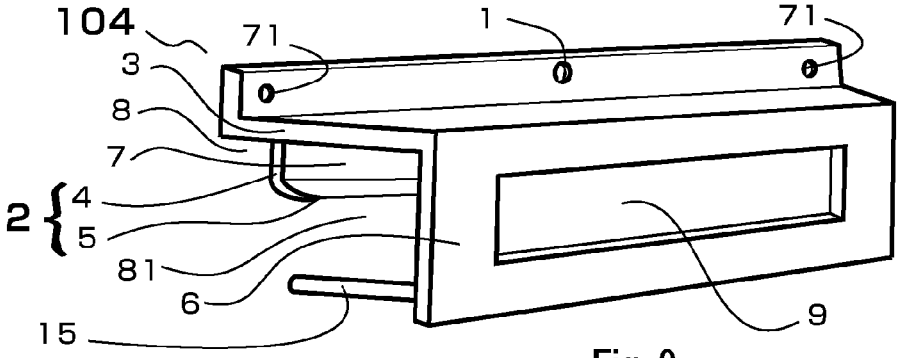
Fig. 9

Fig. 10
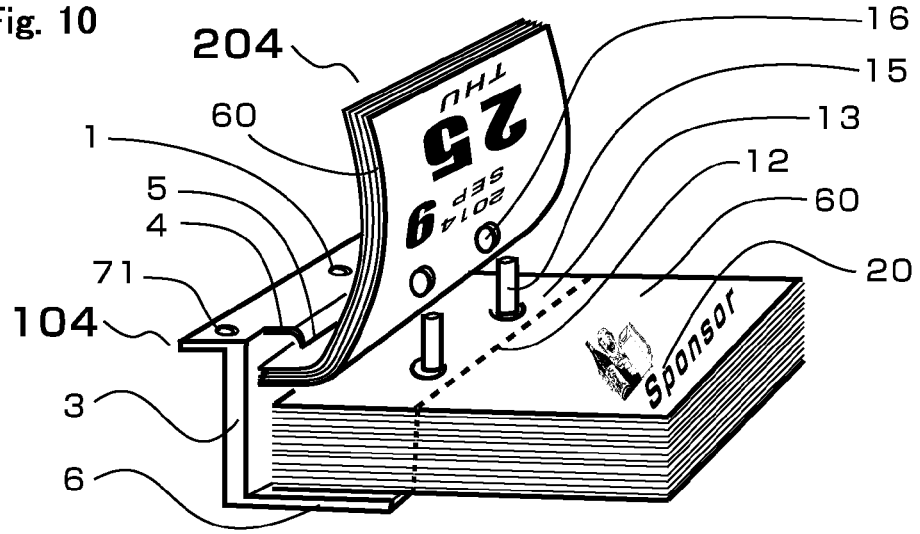
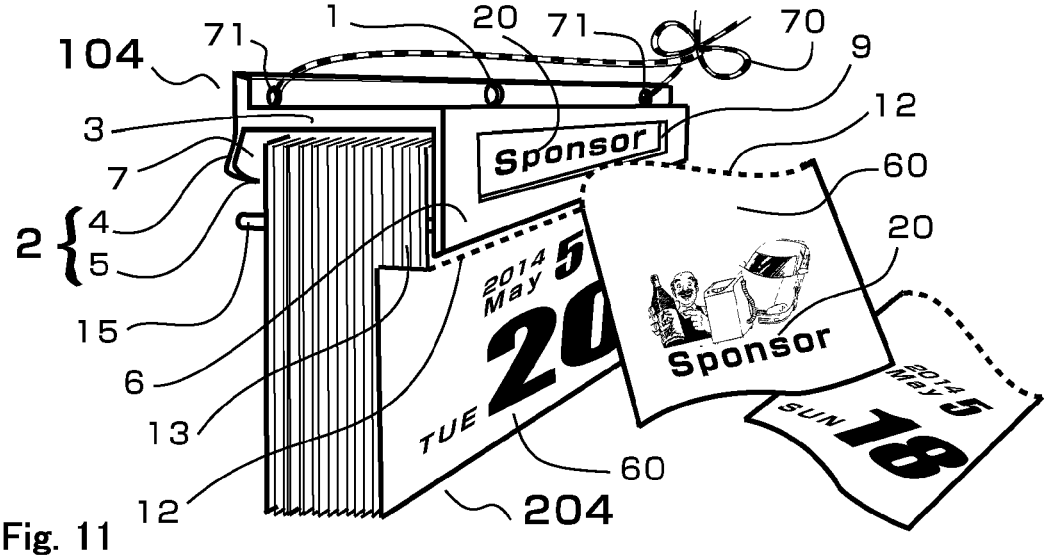
Fig. 11

105

106

107

108

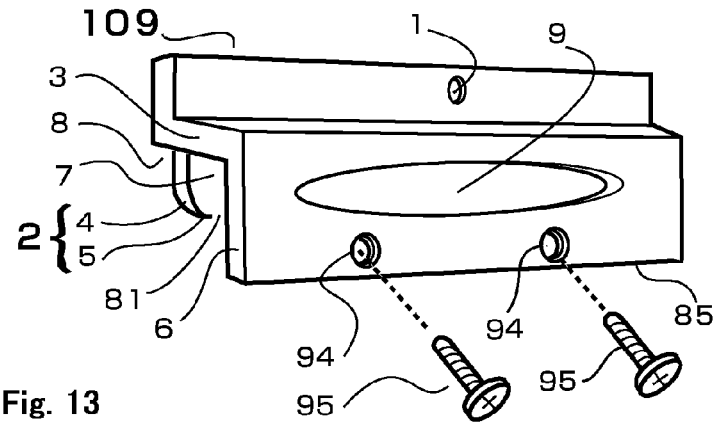
Fig. 13
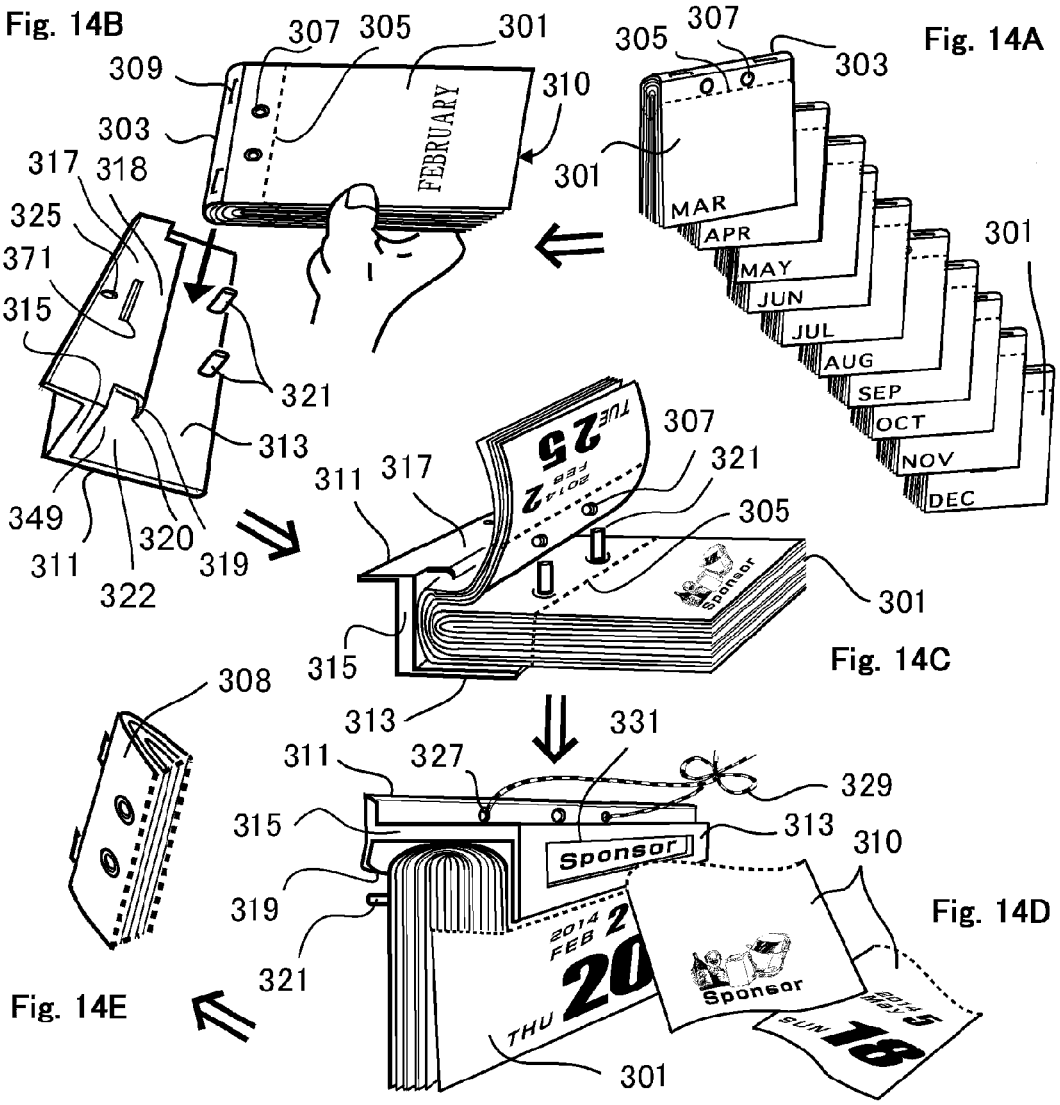

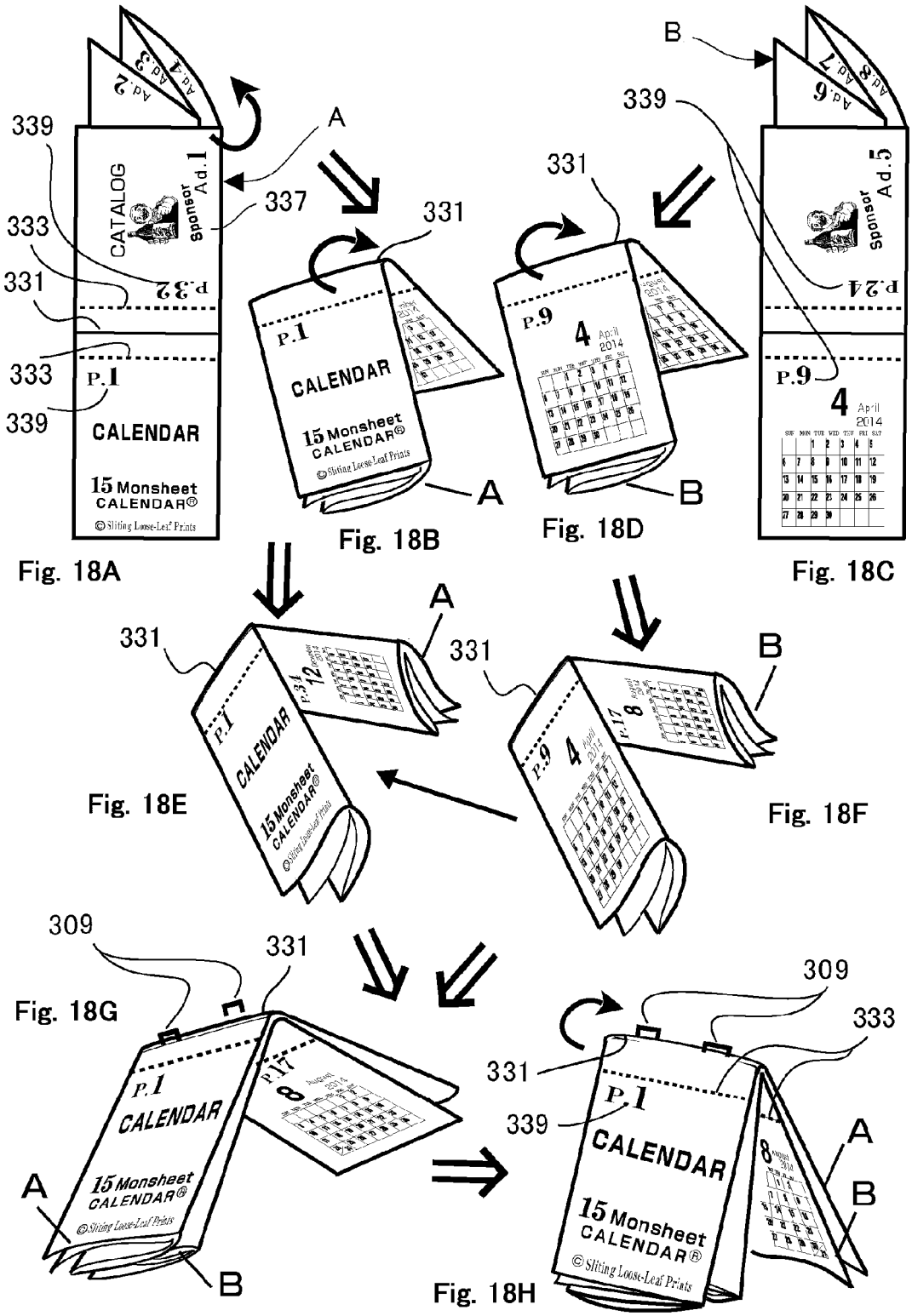
339
333
331
333
339
A
337
CATALOG
Sponsor
Ad.1
Ad.2
Ad.3
Ad.4
P.32
P.1
CALENDAR
15 Monsheet CALENDAR®
©Sliting Loose-Leaf Prints
Fig. 18A
331
P.1
CALENDAR
15 Monsheet CALENDAR®
©Sliting Loose-Leaf Prints
A
Fig. 18B
B
339
331
Ad.5
Ad.6
Ad.7
Ad.8
Sponsor
P.24
P.9
4 April 2014
Fig. 18C
331
P.9
4 April 2014
B
Fig. 18D
A
331
P.1
CALENDAR
15 Monsheet CALENDAR®
©Sliting Loose-Leaf Prints
Fig. 18E
331
B
P.9
4 April 2014
Fig. 18F
309
331
Fig. 18G
P.1
CALENDAR
15 Monsheet CALENDAR®
©Sliting Loose-Leaf Prints
A
B
309
333
331
339
P.1
CALENDAR
15 Monsheet CALENDAR®
©Sliting Loose-Leaf Prints
A
B
Fig. 18H 309
331
333
339
P.1
CALENDAR
15 Monsheet
CALENDAR®
© Sitting Loose-Leaf Prints
A
B 307
309
331
333
341
P.1
CALENDAR
339
15 Monsheet
CALENDAR®
© Sitting Loose-Leaf Prints
45
A
B
343
344
310
330
339
341
305
331
309
307
CATALOG
Sponsor
Ad. 1
P.32

311
347
371
317
321
319
313
322
349
315
351
357
PINMAG®

347
317
319
305
307
315
321
313
15 Monsheet
CALENDAR
P.1
© Sitting Loose-Leaf Prints
347
313
317
315
Calenda Hanger®
305
319
321
355
341
305
339
330
P.20
P.21
10
Sponsor
Ad. 7
P.17
8

Fig. 20A Fig. 20B Fig. 20C Fig. 20D
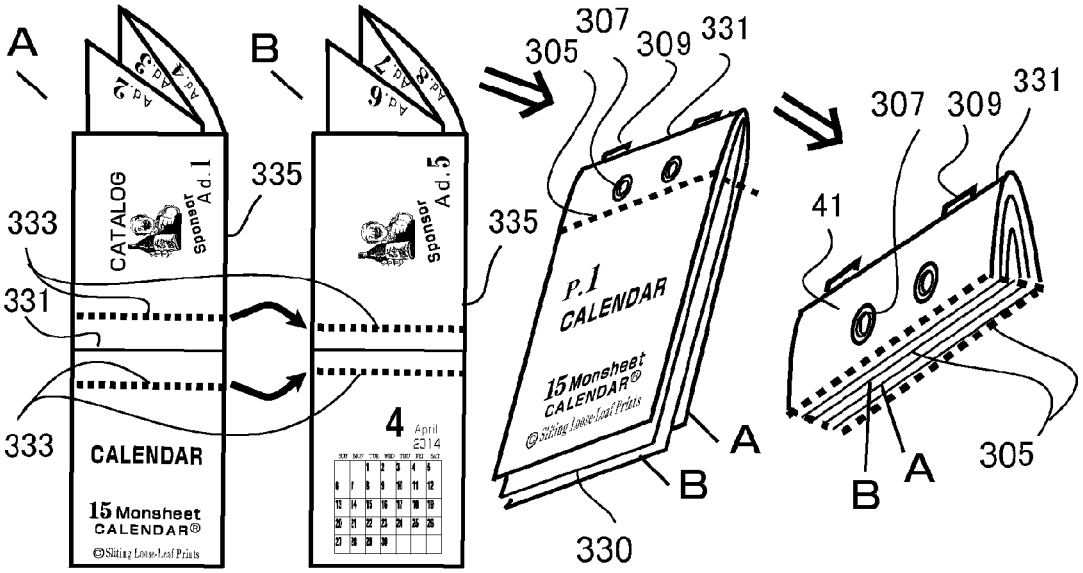
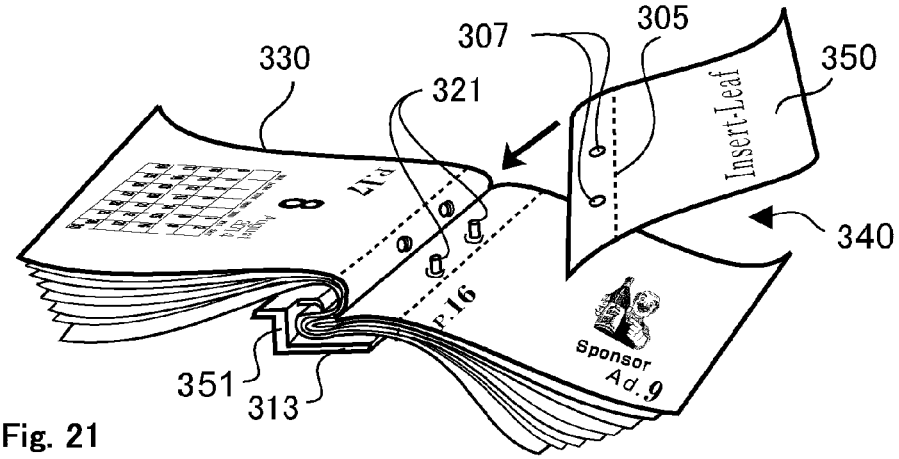
Fig. 21

FILE BINDER, PRINTED MATTER SET, AND PRINTED MATTER

TECHNICAL FIELD

The present invention relates to a file binder that holds a plurality of stacked leaves, a printed matter set including the file binder, a printed matter suitable for installment into the file binder, and a manufacturing method suitable for manufacture of the printed matter.

BACKGROUND ART

As a means for binding a plurality of leaves (also referred to as the "leaf group") on which monthly tables of a calendar and the like are printed, a means of catching up and binding a top part of the leaf group with a top fitting, a means of binding by bonding a binding tool with an adhesive liquid, a means of binding with rings passing through punched holes formed in a top part, a means of binding by letting a wire through a large number of punched holes formed along a top part, and the like are known (for example, Patent Documents 1 and 2).

In these known means, the leaf group and the binding tool are integrally combined. Thus, in a case where a defective item of printing failure or the like is generated in some leaves among the leaf group, replacement of only the defective item is not easily performed, and there is a problem that the entire bound leaf group is unavoidably disposed. Additionally, in a case where a user disposes the bound leaf group after use, the leaf group and the binding tool are not easily separated. Thus, there is a problem that the leaf group is unavoidably disposed while the leaf group and the binding tool are combined.

Meanwhile, the same applicant has proposed file binders capable of detachably binding a leaf group and putting the leaf group on a table, a wall surface, or the like (for example, Patent Documents 3 to 6). Further, a file binder into and from which a leaf group is freely installed and detached, the file binder to be provided at furthermore low cost has been desired.

PRIOR ART DOCUMENTS

Patent Documents

Patent Document 1: Japanese Patent Laid-open Publication No. 8-318687

Patent Document 2: Japanese Patent Laid-open Publication No. 2000-6549

Patent Document 3: Japanese Patent No. 4709940

Patent Document 4: Japanese Patent No. 4763844

Patent Document 5: Japanese Patent No. 4913253

Patent Document 6: Japanese Patent No. 5021059

SUMMARY OF THE INVENTION

Problems to be Solved by the Invention

The present invention is achieved in consideration of the above problems, and an object thereof is to provide a file binder into and from which a leaf group is freely installed and detached, the file binder to be provided at lower cost. Another object of the present invention is to provide a printed matter set including the file binder, and a leaf group serving as an object to be bound. Further, still another object of the present invention is to provide a printed matter suitable for installment into the file binder. Further, yet another object of the present invention is to provide a method suitable for manufacture of the printed matter.

Solutions to the Problems

In order to solve the above problems and to achieve the above objects, a file binder according to a first aspect of the present invention includes a back side plate member, a projecting member, and a front side plate member. A lower end part of the back side plate member is bent forward. The projecting member projects forward from a part of the back side plate member higher than the lower end part. The front side plate member extends downward from a front end part of the projecting member. The front side plate member further extends downward beyond a front end edge of the lower end part of the back side plate member, and forms a gap from the front end edge.

With this configuration, a bag shape space having the gap on the side of the front side plate member at a lower end is formed between the back side plate member and the front side plate member. By folding upper end parts of a plurality of leaves and inserting the folded upper end parts into the bag shape space, the upper end parts of the plurality of leaves can be locked in the space. In such a way, only by stacking the plurality of leaves whose upper end parts are folded, the plurality of leaves can be simply bound. As one mode of the file binder, it can be formed in a mode suitable for hanging the plurality of leaves in a bound state, such as a mode where the back side plate member is formed in a mode suitable for attachment to a wall surface or the like. The plurality of leaves are not necessarily bound by glue or the like. Thus, after printing is done on the plurality of leaves, some leaves can be easily replaced.

In a state where the folded upper end parts of the plurality of leaves are bound each other by a simple and convenient means such as a stapler, the plurality of leaves can also be installed into the file binder. In this case, a provider of the plurality of leaves can provide the plurality of leaves in an unbound state to an end user, and binding by the means of a stapler or the like can be left to the end user. Thereby, the provider can easily replace some leaves after printing is done on the plurality of leaves. In any manner of installment, the plurality of leaves can be easily installed into and detached from the file binder. Thus, only the plurality of leaves can be easily separated and disposed. Further, a structure of the file binder is plain. Thus, in comparison to a conventional file binder requiring an open and close mechanism, the file binder can be manufactured at lower cost.

A file binder according to a second aspect of the present invention is the file binder according to the first aspect, further including at least one pillar shape protruding portion protruding backward from a back surface of the front side plate member. The at least one pillar shape protruding portion is placed lower than a lowermost end of the back side plate member, and extends backward beyond the front end edge of the back side plate member.

With this configuration, by forming at least one through hole in a common part in the vicinity of the upper end parts of the plurality of leaves and inserting the at least one pillar shape protruding portion into the at least one through hole, the plurality of leaves can be bound in a state where the leaves are less detachable from the file binder. Without folding the upper end parts of the plurality of leaves and without binding the upper end parts by the means of a stapler or the like, the plurality of leaves can be bound each other. Since the at least one pillar shape protruding portion extends backward beyond the front end edge of the back side plate member, the plurality of leaves extending to an exterior from the bag shape space through the gap between this front end edge and the front side plate member is less detachable from the at least one pillar shape protruding portion.

A file binder according to a third aspect of the present invention is the file binder according to the second aspect, wherein the at least one pillar shape protruding portion protrudes by such length that, when the back side plate member is abutted with a wall surface, a tip is substantially abutted with the wall surface.

With this configuration, when the file binder is attached to the wall surface in such a manner that the back side plate member is abutted with the wall surface, the at least one pillar shape protruding portion is substantially abutted with the wall surface. Thus, a posture of the file binder is stabilized on the wall surface.

A file binder according to a fourth aspect of the present invention is the file binder according to any of the first to third aspects, wherein at least one of right and left end edges of the back side plate member retreats to a center side with respect to a corresponding one of right and left end edges of the front side plate member.

With this configuration, a task of installing the leaves into the file binder performed by stacking the plurality of leaves and letting the leaves horizontally slide from at least one of the right and left end edges of the front side plate member and the back side plate member can easily be done.

A file binder according to a fifth aspect of the present invention is the file binder according to any of the first to fourth aspects, wherein an opening portion is formed in part of the front side plate member.

With this configuration, through the opening portion, printing done on a corresponding part of a leaf placed on the foremost side of the plurality of leaves can be seen.

A file binder according to a sixth aspect of the present invention is the file binder according to any of the first to fourth aspects, wherein at least part of the front side plate member is transparent.

With this configuration, through the transparent part, printing done on a corresponding part of a leaf placed on the foremost side of the plurality of leaves can be seen.

A file binder according to a seventh aspect of the present invention is the file binder according to any of the first to sixth aspects, wherein a through hole passing through a part of the back side plate member higher than the projecting member in a back and forth direction is formed.

With this configuration, by utilizing the through hole formed in the back side plate member, the file binder can be locked onto the wall surface or the like with a locking tool such as a pushpin. Since the through hole is placed in the part higher than the projecting member, the posture of the file binder is stabilized.

A file binder according to a seventh aspect of the present invention is the file binder according to the second aspect, wherein the at least one pillar shape protruding portion has, at a tip part, a leaf stopping member having a step wall.

With this configuration, by forming at least one through hole in each of one end parts of the leaves, inserting the one end parts between the back side plate member and the front side plate member, and inserting the at least one pillar shape protruding portion into the at least one through hole of each of the leaves, the leaves can be held. Since the at least one pillar shape protruding portion has, at a tip part, the leaf stopping member having the step wall, the leaves are suppressed from carelessly dropping off the at least one pillar shape protruding portion.

A file binder according to an eighth aspect of the present invention is the printed matter file binder according to the seventh aspect, wherein the at least one pillar shape protruding portion passes through the front side plate member, is movable back and forth with respect to the front side plate member by finger pressure of a human being, and has, at another tip part protruding forward from the front side plate member, a retaining member having a step wall With the file binder of this configuration, by moving the at least one pillar shape protruding portion forward by finger pressure when installing the leaves, the one end parts can be inserted between the front side plate member and the back side plate member without curling the leaves. By moving the at least one pillar shape protruding portion backward by finger pressure after that, the pillar shape protruding portion can be inserted into the through holes of the leaves. In such a way, the leaves can be installed into the binder of the present configuration without curling the leaves. Since the at least one pillar shape protruding portion has the leaf stopping member and the retaining member at both the tip parts, the pillar shape protruding portion does not drop off the front side plate member.

A printed matter set according to a ninth aspect of the present invention is a printed matter set including the file binder according to any of the first to seventh aspects, the file binder having no characteristics of the second aspect, and a plurality of leaves installable into the file binder and having printing done on each of the leaves. Folding perforations are formed in the one end part in each of the plurality of leaves.

With this configuration, by folding the plurality of leaves along the folding perforations and installing the leaves into the file binder in a stacked state, the plurality of leaves can be simply bound. In a state where the folded one end parts of the plurality of leaves are bound by a simple and convenient means such as a stapler, the plurality of leaves can also be installed into the file binder.

A printed matter set according to a tenth aspect of the present invention is the printed matter set according to the ninth aspect, wherein cutout perforations are formed at a position of the one end part in each of the plurality of leaves, and the position corresponds to a lowermost end edge of the front side plate member of the file binder when the plurality of leaves is installed into the file binder.

With this configuration, while utilizing the lowermost end edge of the front side plate member of the file binder, the plurality of leaves can be cut and removed along the cutout perforations in order from the foremost side with the one end parts left. One mode of the printed matter set is for example suitable for a monthly calendar.

A printed matter set according to an eleventh aspect of the present invention is a printed matter set including the file binder according to any of the first to seventh aspects, the file binder having the characteristics of the second aspect, and a plurality of leaves installable into the file binder and having printing done on each of the leaves. A through hole is formed at least one spot in one end part of each of the plurality of leaves, the at least one spot corresponding to the at least one pillar shape protruding portion of the file binder when the plurality of leaves are installed into the file binder. Cutout perforations are further formed at a position of the one end part of each of the plurality of leaves, the position corresponding to a lowermost end edge of the front side plate member of the file binder when the plurality of leaves are installed into the file binder.

With this configuration, by inserting the at least one pillar shape protruding portion into the at least one through hole of each of the plurality of leaves and installing the leaves into the file binder, the plurality of leaves can be simply bound. While utilizing the lowermost end edge of the front side plate member of the file binder, the plurality of leaves can be cut and removed along the cutout perforations in order from the foremost side with the one end parts left. One mode of the printed matter set is for example suitable for a monthly calendar.

A printed matter according to a twelfth aspect of the present invention is a printed matter including three or more leaves bound at one side. Each of the three or more leaves defines a plurality of through holes formed along the one side in a vicinity of the one side, the through holes being formed at spots that substantially match between the three or more stacked leaves, and a cutout punched hole row formed along the one side at a position in a vicinity of the one side, the position being more distant from the one side than the plurality of through holes, the punched hole row being formed at a position that substantially matches between the three or more stacked leaves.

With this configuration, by inserting the plurality of pillar shape protruding portions of the file binder according to one aspect of the present invention into the plurality of through holes of the printed matter, the printed matter can be installed into the file binder. While utilizing the lowermost end edge of the front side plate member of the file binder, the plurality of leaves can be cut and removed along the cutout punched hole row in order from the foremost side with the one end parts left. Since the printed matter of the present configuration is already bound before being installed into the file binder, the printed matter is convenient to be handled. The printed matter of the present configuration is for example suitable for a monthly calendar or a daily calendar. The cutout punched hole row includes for example so-called cutout perforations and so-called cutout slits.

A printed matter according to a thirteenth aspect of the present invention is the printed matter according to the twelfth aspect, wherein the three or more leaves are four or more leaves bound by saddle-stitching at one side. The cutout punched hole row is formed more distantly from the one side successively or in a stepwise manner from the inner leaf toward the outer leaf among the four or more leaves, and thereby, the cutout punched hole row is formed at a position that substantially matches between the four or more stacked leaves.

With this configuration, although the four or more leaves are bound by saddle-stitching, the printed matter in which the cutout punched hole rows are formed at positions that substantially match each other between the four or more stacked leaves is realized.

A printed matter according to a fourteenth aspect of the present invention is the printed matter according to the thirteenth aspect, wherein the four or more leaves are sixteen leaves, and include a leaf group in which monthly tables of a calendar for a common year are successively printed on respective regions, each of the regions being more distant from the one side than the cutout punched hole row.

The printed matter of this configuration can be used as a monthly calendar in which the leaves can be cut along the cutout punched hole rows by installing the printed matter into the file binder according to one aspect of the present invention. Further, since the leaves are sixteen, the present configuration is advantageous when the printed matter of the configuration is manufactured by performing printing on and folding one or a plurality of printing sheet.

A printed matter according to a fifteenth aspect of the present invention is the printed matter according to the thirteenth aspect, wherein the four or more leaves are thirty-two leaves, and include a leaf group in which daily tables of a calendar for a common year and month are successively printed on respective regions, each of the regions being more distant from the one side than the cutout punched hole row.

The printed matter of this configuration can be used as a daily calendar in which the leaves can be cut along the cutout punched hole rows by installing the printed matter into the file binder according to one aspect of the present invention. Further, since the leaves are thirty-two, the present configuration is advantageous when the printed matter of the configuration is manufactured by performing printing on and folding one or a plurality of printing sheet.

A printed matter according to a sixteenth aspect of the present invention is the printed matter according to any of the twelfth to fifteenth aspects further including another leaf whose outline substantially matches with outlines of the four or more leaves when stacked on the four or more leaves. The another leaf defines a plurality of other through holes formed at spots that substantially match with the respective plurality of through holes of the four or more leaves when the another leaf is stacked on the four or more leaves, and another cutout punched hole row formed at a position that substantially matches with the respective cutout punched hole rows of the four or more leaves when the another leaf is stacked on the four or more leaves.

With this configuration, the another leaf can be installed into the file binder according to one aspect of the present invention together with the four or more leaves by inserting the another leaf between the four or more leaves or stacking the another leaf on the leaves. With the present configuration, the another leaf may be inserted between the four or more leaves or may be stacked on the leaves, or may be not yet inserted or stacked in order to leave it to an operation of a user or the like.

A seventeenth aspect of the present invention is directed to a method of manufacturing the printed matter according to the thirteenth aspect, including the followings: that is, performing printing on each of two or more printing sheets, and forming cutout punched hole rows in a vicinity of and on both sides of a center-folding reference line along the reference line for each of the printing sheets in such a manner that a distance from the reference line is different between the printing sheets; folding, after performing the printing and forming the cutout punched hole rows, each of the two or more printing sheets in such a manner that the reference line remains one or overlies itself; stacking the folded two or more printing sheets in such a manner that the reference lines overlie each other and the printing sheet having the shorter distance is placed on an inner side when the printing sheets are bound; saddle-stitching the two or more stacked printing sheets on the overlying reference lines; cutting, while keeping the two or more saddle-stitched printing sheets in a state where the printing sheets are folded along the reference lines, three sides of the entire two or more printing sheets; and forming, while keeping the two or more saddle-stitched printing sheets in a state where the printing sheets are folded along the reference lines, a plurality of through holes passing through the entire two or more printing sheets along the reference line and between the reference line and the cutout punched hole rows of each of the printing sheets.

With the manufacturing method of this configuration, the printed matter according to the thirteenth aspect of the present invention is obtained by sheet printing. The phrase "folding each of the two or more printing sheets in such a manner that the reference line remains one or overlies itself" will be additionally explained. When the center-folding reference line is one for each printing sheet and the printing sheet is folded in a folio, the reference line is not broken and this corresponds to a case where the reference line remains one. When the center-folding reference line is one for each printing sheet and the printing sheet is folded in a quarto or more, this corresponds to a case where the printing sheet is folded so that the reference line overlies itself to make one line. When for example two parallel center-folding reference lines are provided for each printing sheet and the printing sheet is folded in an octavo or sixteenmo, this corresponds to a case where the printing sheet is folded so that all the two reference lines overlie themselves to make one line.

An eighteenth aspect of the present invention is directed to a method of manufacturing the printed matter according to the thirteenth aspect, including the followings: that is, performing printing on a predetermined region in each of two or more rolls of long printing sheets, and forming cutout punched hole rows in a vicinity of and on both sides of a center-folding reference line along the reference line for each of the printing sheets in such a manner that a distance from the reference line is different between the printing sheets; cutting out the predetermined region from each of the two or more rolls of long printing sheets; folding each of the two or more cut printing sheets in such a manner that the reference line remains one or overlies itself; stacking the two or more folded printing sheets in such a manner that the reference lines overlie each other and the printing sheet having the shorter distance is placed on an inner side when the printing sheets are bound; saddle-stitching the two or more stacked printing sheets on the overlying reference lines; cutting, while keeping the two or more saddle-stitched printing sheets in a state where the printing sheets are folded along the reference line, three sides of the entire two or more printing sheets; and forming, while keeping the two or more saddle-stitched printing sheets in a state where the printing sheets are folded along the reference line, a plurality of through holes passing through the entire two or more printing sheets along the reference line and between the reference line and the cutout punched hole rows of each of the printing sheets.

With the manufacturing method of this configuration, the printed matter according to the thirteenth aspect of the present invention can be obtained by rotary printing at lower cost.

Effects of the Invention

According to the present invention as described above, the file binder into and from which the leaf group is freely installed and detached, the file binder to be provided at lower cost is realized. Further, the printed matter set including the file binder, and the leaf group serving as an object to be bound is obtained. Additionally, the printed matter suitable for installment into the file binder is obtained. Further, the method suitable for manufacture of the printed matter is obtained.

The objects, characteristics, features, and advantages of the present invention will be elucidated by the following detailed description and the attached drawings.

BRIEF DESCRIPTION OF THE DRAWINGS

FIG. 1 is a perspective back view of a file binder according to one embodiment of the present invention.

FIGS. 2A to 2E are process views exemplifying a task procedure for using the file binder of FIG. 1.

FIG. 6 is a perspective front view exemplifying a leaf to be installed into the file binder of FIG. 4.

FIGS. 7A and 7B are process views exemplifying a procedure of preparing a leaf group to be installed into the file binder of FIG. 4.

FIGS. 8A to 8C are process views exemplifying a task procedure for using a file binder according to still another embodiment of the present invention.

FIG. 9 is a perspective front view of a file binder according to yet another embodiment of the present invention.

FIG. 10 is an illustrative view exemplifying a task of installing a leaf group into the file binder of FIG. 9.

FIG. 11 is an illustrative view exemplifying a use method of the file binder of FIG. 9.

FIG. 13 is a perspective front view of a file binder according to further another embodiment of the present invention.

FIGS. 14A to 14E are illustrative views showing configurations of a file binder according to furthermore another embodiment of the present invention, and a printed matter according to one embodiment suitable for installment into the file binder.

FIGS. 18A to 18H are process views exemplifying a manufacturing method of the printed matter according to the another embodiment of the present invention.

FIGS. 20A to 20D are process views exemplifying a manufacturing method of the printed matter according to the another embodiment of the present invention.

FIG. 21 is an illustrative view showing a configuration of a printed matter according to still another embodiment of the present invention, and a use method.

EMBODIMENTS OF THE INVENTION

Figure 3A:
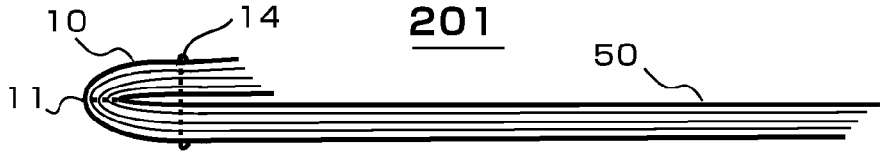
FIGS. 3A and 3B are side views exemplifying how to stack a leaf group exemplified in FIGS. 2A to 2E.

FIG. 1 is a perspective back view of a file binder according to one embodiment of the present invention. It should be noted that part of the perspective views attached to the description are made under the rules of perspective. Expressions indicating the positions or the directions such as "front side", "back side", "front", "back", "upper", "lower", "left", "lower", and "horizontal" are based on a standard posture of the file binder used while being attached to a wall surface in order to hang a leaf group serving as an object to be bound. A file binder 101 exemplified in FIG. 1 can be used while being attached to a wall surface or the like.

The file binder 101 has a back side plate member 2, a projecting member 3, and a front side plate member 6. The back side plate member 2, the projecting member 3, and the front side plate member 6 are for example formed by integrally molding plastic. The back side plate member 2 includes a main body part 4 and a lower end part 5 extending downward therefrom. The main body part 4 is formed in a flat plate shape so as to be along the wall surface to which the file binder is to be attached. The lower end part 5 is bent forward with respect to the main body part 4. In FIG. 1, the lower end part 5 is curved forward. However, the lower end part may be bent with an angle from the main body part 4 for example at 90 degrees. In any case, the lower end part 5 remains bent forward with respect to the main body part 4.

The projecting portion 3 projecting forward is coupled to a part of the back side plate member 2, and the part lies on the upper side of the lower end part 5 and on the lower side of an upper end edge, for example, in the vicinity of center of the main body part 4. In the example of FIG. 1, the projecting portion 3 is a plate shape body extending right and left. The front side plate member 6 extending downward is coupled to a front end part of the projecting portion 3. In the example of FIG. 1, a main surface of the front side plate member 6 is parallel with a main surface of the main body part 4 of the back side plate member 2. In the example of FIG. 1, the projecting portion 3 not only couples the back side plate member 2 and the front side plate member 6 but also plays a role as a rib that provides rigidity against curve on a horizontal plane to the file binder 101.

The front side plate member 6 extends downward beyond a front end edge 80 of the lower end part 5 of the back side plate member 2, and forms a gap 81 from this front end edge 80. With this configuration, a bag shape space 7 is formed between the back side plate member 2 and the front side plate member 6. The space 7 has the gap 81 at a lower end thereof on the side of the front side plate member 6. In the example of FIG. 1, the front end edge 80 of the lower end part 5 is formed in a saw-tooth form or a wave form so as to effectively prevent drop-off of a plurality of thick leaves by pressing the leaves with elastic restoring force generated in accordance with deformation of the back side plate member 2, the projecting portion 3, or the front side plate member 6.

A through hole 1 passing through in a back and forth direction is formed in an upper end part of the back side plate member 2. By inserting a nail, a pushpin, a screw, a hook, or the like into this through hole 1, the file binder 101 can be easily attached to the wall surface.

An end edge 8 of the back side plate member 2 on the lower side of the projecting member 3 and on the right side when seen from the back side retreats closer to the center than a corresponding end edge of the front side plate member 6 on the right side. This configuration is to facilitate a task of attaching the plurality of leaves to the file binder 101. An advantage of the retreating end edge 8 will be described later with reference to FIGS. 8A to 8C.

FIGS. 2A to 2E are task process views showing a process of binding the leaves into the file binder 101 in order to use the file binder 101. FIG. 2A is a perspective front view of the file binder 101. An opening portion 9 is formed in part of the front side plate member 6 of the file binder 101. With the opening portion 9, a user or the like can see contents printed on the leaves from the front side through the opening portion 9.

As shown in FIG. 2B, printing is done on each of a plurality of leaves (leaf group) 201 serving as an object to be bound into the file binder 101. In the example of FIG. 2B, the leaf group 201 includes monthly tables 50 of a calendar. Folding perforations 11 and cutout perforations 12 are formed in an upper end part of each leaf 201. These perforations 11, 12 are formed in parallel with an upper end edge of each leaf 201, and the folding perforations 11 and the cutout perforations 12 are formed in this order from the upper end edge. The monthly table 50 forms a part lower than the cutout perforations 12 in each leaf 201. It should be noted that in the description, each one leaf in the leaf group 201 is also given the same reference sign, as a leaf 201, for convenience.

As shown in FIG. 2C, each leaf in the leaf group 201 is folded along the folding perforations 11. Thereby, in each leaf in the leaf group 201, a folding back bound margin 10 along the upper end edge is folded with respect to the remaining main body part. In the example in which the leaf group 201 includes the monthly tables 50 of the calendar, as one example, the file binder 101 and the leaf group 201 are provided from a calendar provider to the user. Regarding the leaf group 201, a leaf group 201 on which a new year calendar is printed is provided to the user for every coming year. As one example, the user is provided with the leaf group 201 in which the leaves are not folded but stacked on each other. In this case, folding each leaf in the leaf group 201 along the folding perforations 11 is a task of the user.

As shown in FIG. 2D, the folded leaves in the leaf group 201 are stacked on each other, and parts of the folding back bound margins 10 are simply and conveniently bound each other by fastening fittings 14 of a stapler or the like. Thereby, the folding back bound margins 10 of the leaf group 201 are thickened. By inserting the thickened the folding back bound margins 10 into the bag shape space 7 of the file binder 101, as shown in FIG. 2E, the upper end parts of the leaves in the leaf group 201 can be locked onto the lower end part 5 of the back side plate member 2 and the leaf group 201 can also be hanged so as to sag downward through the gap 81. By locking the through hole 1 formed in the upper end part of the back side plate member 2 onto a nail or the like fixed to the wall surface in a state where the leaf group 201 is bound, the file binder 101 can be easily hanged or fixed to the wall surface.

The cutout perforations 12 of the leaf group 201 are formed to be placed at a position corresponding to a lowermost end edge 85 of the front side plate member 6 (refer to FIG. 2A) in a state where the leaf group 201 is installed into the file binder 101. Therefore, the leaves in the leaf group 201 can be easily cut along the cutout perforations 12 in order from the front side. Thereby, the user of the file binder 101 and the leaf group 201 can easily cut and remove the monthly table 50 of the previous month which is disused in each month. In such a way, the leaf group 201 held by the file binder 101 in a bound state can be used as a wall monthly calendar.

Even when the monthly table 50 is cut and removed, the remaining part of paper 13 corresponding to a part on the upper side of the cutout perforations 12 remains in the bag shape space 7. The user can see printing 20 done on a front surface of the foremost remaining part of paper 13 through the opening portion 9. For example, as the printing 20, by placing an advertisement of a sponsor or the like of the leaf group 201 as a calendar, the advertisement or the like can be not cut and removed but continuously displayed.

Figure 3B:
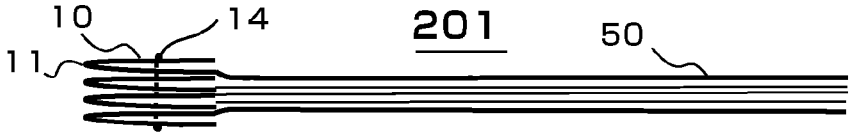

As exemplified in FIG. 3A among side views of the leaf group 201 exemplified in FIGS. 3A and 3B, the leaves in the leaf group 201 may be stacked on each other in such a manner that the folded parts nest each other. In this case, the leaf group 201 can also be installed into the file binder 101 without binding by using the fastening fittings 14 of the stapler or the like. FIG. 3A exemplifies a mode in which the leaf group is bound by using the fastening fittings 14 of the stapler. FIG. 3B is a side view of the leaves in the leaf group 201 stacked by the method exemplified in FIG. 2D and bound by using the fastening fittings 14 of the stapler.

Figure 4:
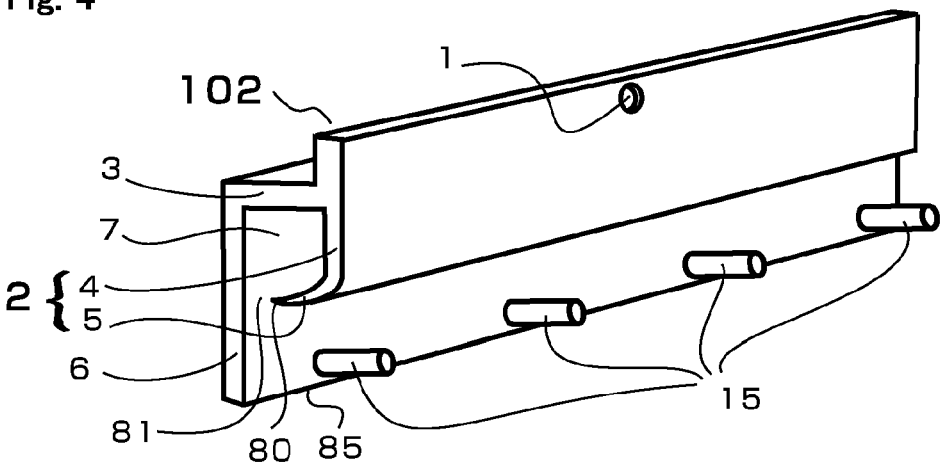
FIG. 4 is a perspective back view of a file binder according to another embodiment of the present invention.
Figure 5:
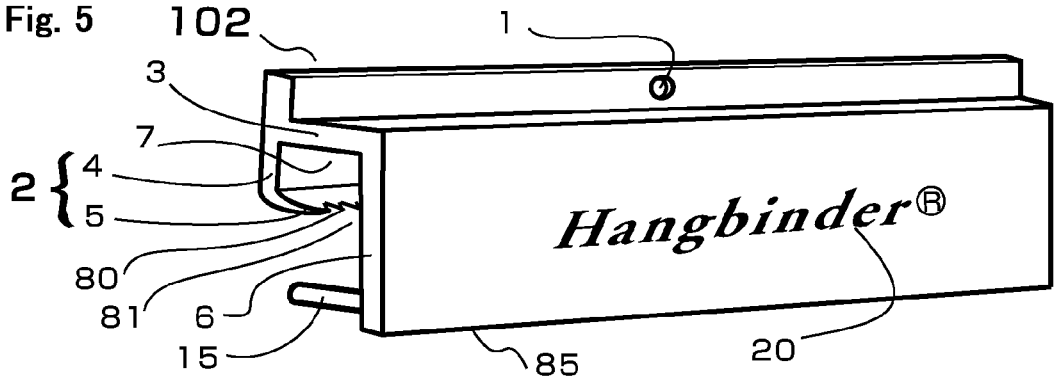
FIG. 5 is a perspective front view of the file binder of FIG. 4.

FIG. 4 is a perspective back view of a file binder according to another embodiment of the present invention. FIG. 5 is a perspective front view of the same file binder. In the figures of FIG. 4 and later, parts corresponding to the parts of the file binder and the leaf group exemplified in FIGS. 1 to 3 will be given the same reference signs. A file binder 102 shown in FIGS. 4 and 5 is different from the file binder 101 of FIG. 1 in a point where pillar shape protruding portions 15 protruding backward from a back surface of the front side plate member 6 are formed.

In the example of FIG. 4, four pillar shape protruding portions 15 are symmetrically formed to be placed at equal intervals in the horizontal direction. The pillar shape protruding portions 15 are placed lower than a lowermost end of the back side plate member 2, and extend backward beyond the front end edge 80 of the lower end part 5 of the back side plate member 2 and further reach onto the same plane as a back surface of the main body part 4 of the back side plate member 2. That is, the pillar shape protruding portions 15 are set to have such length that, when the back surface of the back side plate member 2 is abutted with the wall surface, tips are abutted with this wall surface or substantially abutted with the wall surface.

In the example of FIGS. 4 and 5, unlike the example of FIG. 1, both the right and left end edges of the back side plate member 4 do not retreat toward a center part from the corresponding end edges of the front side plate member 6. Needless to say, major advantages of the present invention are not deteriorated by this configuration.

FIG. 6 is a perspective front view showing an example of one leaf in the leaf group to be installed into the file binder 102. This leaf 202 is different from the leaf 201 exemplified in FIG. 2B in a point where the folding perforations 11 are not formed but instead, through holes 16 are formed in the remaining part of paper 13 along the cutout perforations 12. In the example of FIG. 6, a part lower than the perforations 12 forms a monthly table of a calendar. The through holes 16 function as binding holes of the leaf 202, and are formed in such a manner that the protrusions 15 can be inserted. The perforations 12 are formed in a part corresponding to the lowermost end edge 85 of the front side plate member 6 when the leaf 202 is installed into the file binder 102 by inserting the protrusions 15 into the through holes 16. By directly stacking the plurality of leaves 202 on each other, the leaves can be installed into the file binder 102 as the leaf group 202.

Meanwhile, as exemplified in FIGS. 7A and 7B, a leaf 203 formed by coupling upper sides of two leaves 202 to each other can also be installed into the file binder 102. FIGS. 7A and 7B are process views exemplifying a procedure of preparing the leaf group 203 to be installed into the file binder 102. As shown in FIG. 7A as one example, the leaf group 203 is formed by stacking the already-printed leaves in each of which the upper sides are coupled and continued to each other and by connecting the coupled parts 83 to each other for example by the fastening fittings 14 of the stapler. The leaf group 203 is provided to the user for example in a state of FIG. 7A. The leaves in this leaf group 203 are folded along the coupled parts 83 as shown in FIG. 7B. This task is performed for example by the user. By being installed into the file binder 102, the folded leaf group 202 is used for example as a wall calendar.

FIGS. 8A to 8C are process views showing a task procedure for using a file binder according to still another embodiment of the present invention. As shown in FIG. 8A, this file binder 103 is different from the file binder 102 shown in FIGS. 4 and 5 in a point where two pillar shape protruding portions 15 are provided and both the right and left end edges of the back side plate member 2 on the lower side of the projecting portion 3 retreat to the center with respect to the corresponding end edges of the front side plate member 6. The pillar shape protruding portions 15 are symmetrically formed at a standard interval for binding holes of leaves, that is, at an interval of 8 cm.

The leaf group to be installed into the file binder 103 may be the leaf group 203 exemplified in FIGS. 7A and 7B. However, FIG. 8A exemplifies the leaf group 202 in which the leaves are not bound by the fastening fittings 14 or the like and the upper sides are not coupled by the coupled parts 83. As exemplified in FIG. 6, each leaf 202 includes the monthly table 50 of one month.

As shown in FIG. 8A, the leaves in the leaf group 202 separated from each other are stacked on each other and the leaves are horizontally slid from at least one of the right and left end edges of the front side plate member 6 and the back side plate member 2 of the reversed file binder 103 to the other end edges, thereby enabling the leaf group to be installed into the file binder 103. In this process, an upper end part of the leaf group 202 is placed on the vicinity of one of right and left end parts of the front side plate member 6, the part being not covered by the back side plate member 2, and is slid to the other end part while curling the leaf group 202 in order to avoid contact with the pillar shape protruding portions 15. The end edges in the right and left direction of the back side plate member 2 on the lower side of the projecting portion 3 retreat to the center with respect to the corresponding end edges of the front side plate member 6. Thus, by once mounting the upper end part of the leaf group 202 onto the back surface of the front side plate member 6 and directly letting the upper end part slide, the leaf group 202 can be slipped into the gap 81 between the back side plate member 2 and the front side plate member 6 without difficulty.

As shown in FIG. 8B, when right and left positions of the leaf group 202 are set at predetermined final positions, by undoing the curl of the leaf group 202, the pillar shape protruding portions 15 are inserted into the through holes 16. As a result, as shown in FIG. 8C, by engaging the pillar shape protruding portions 15 with the through holes 16 of the leaf group 202, the leaf group 202 is held in a state where the leaf group is bound in the file binder 103. Therefore, there is no need for folding the upper end part of the leaf group 202. Since the pillar shape protruding portions 15 extend backward beyond the front end edge 80 of the lower end part 5 of the back side plate member 2 (refer to FIG. 8A), the leaf group 202 sagging from the gap 81 between the front end edge 80 and the front side plate member 6 is stably held by the pillar shape protruding portions 15.

As shown in FIG. 8A, since both the right and left end edges of the back side plate member 2 on the lower side of the projecting portion 3 retreat to the center with respect to the corresponding end edges of the front side plate member 6, the file binder 103 is suitable for installing the leaf group 202 from any of the right and left sides. For a right-handed user, it is convenient to install the leaf group from the right side when seen from the back side of the front side plate member 6 as shown in FIG. 8A. For a left-handed user, it is convenient to install the leaf group from the opposite left side. In such a way, the file binder 103 is also suitable for use by both the right- and left-handed users.

By taking a procedure in the reversed order to the procedure of installing the leaf group 202 into the file binder 103, the leaf group 202 can be easily removed from the file binder 103. Thereby, the user can easily separate the disused leaf group 202 from the file binder 103 and dispose. The file binder 103 can be re-used for installment of a new leaf group 202. A provider of the leaf group 202 only needs to provide the new leaf group 202 when the already-provided leaf group 202 is disused due to an end of the year or the like. The provider of the leaf group 202 can also provide a leaf group 202 exclusive to the file binder 103, and thereby can maintain a relationship with the user. Further, the leaf group 202 can be provided to the user in a state where the leaves are stacked on each other. Thus, even in a case where printing failure or the like is generated in some leaves in the leaf group 202, those who provide the leaf group 202 such as a calendar provider can easily replace only the defective leaves with non-defective leaves. The advantages relating to the file binder 103 described above are also applied to the file binders 101 and 102.

FIG. 9 is a perspective front view of a file binder according to yet another embodiment of the present invention. This file binder 104 is different from the file binder 103 shown in FIGS. 8A to 8C in a point where the gap 81 between the lower end part 5 of the back side plate member 2 and the front side plate member 6 is formed to be wide. The wide gap 81 is suitable for holding a thick leaf group. As exemplified in FIG. 9, together with the through hole 1 or in place of the through hole 1, other through holes 71 may be symmetrically formed in an upper part of the main body part 4 of the back side plate member 2.

In an example shown in FIG. 10, the file binder 104 holds a leaf group 204 formed by stacking leaves including daily tables 60 of a calendar for one year. In order to install the thick leaf group 204 into the file binder 104, for example, the leaf group 204 may be divided into several leaf groups, and the divided leaf groups may be installed into the file binder 104 in order along the procedure described with reference to FIGS. 8A to 8C. By taking a procedure in the reversed order to the procedure of installing the leaf group 204 into the file binder 104, the leaf group 204 can be easily removed from the file binder 104. The leaf group 204 held by the file binder 104 in a bound state can be used as a wall daily calendar as in a use example shown in FIG. 11. As exemplified in FIG. 11, by letting a string 70 through the pair of through holes 71 and locking the string 70 onto a nail, a hook, or the like fixed to a wall, the file binder 104 may be hanged on the wall. This mode is also included in one mode in which the file binder 104 is attached to the wall surface.

Figure 12A:
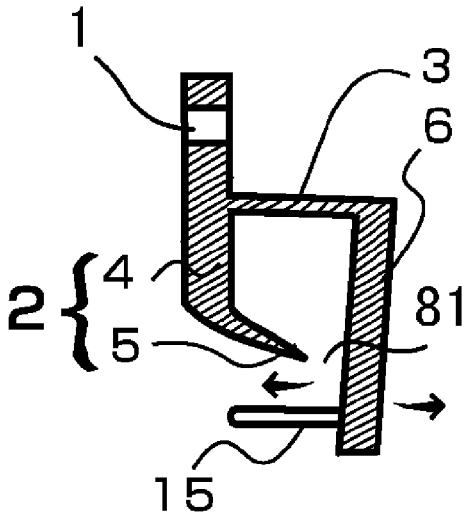
FIGS. 12A to 12D are vertically sectional views of file binders according to further other embodiments of the present invention.

FIGS. 12A to 12D are vertically sectional views of file binders according to further other embodiments of the present invention. A file binder 105 exemplified in FIG. 12A is different from the file binders 101 to 105 in a point where the main surface of the front side plate member 6 is slightly inclined from the vertical direction. The front side plate member 6 formed in such a way also extends downward from the front end part of the projecting member 3 with no difference. As exemplified in FIG. 12A, by reducing thickness of the projecting member 3 or the lower end part 5 of the back side plate member 2, or the like, those members may be made easily elastically deformable. Thereby, the gap 81 can be easily extended with elastic restoring force. As a result, the leaf group to be installed can be nipped by the front side plate member 6 and the lower end part 5 of the back side plate member 2 with elastic restoring force or a task of installing and detaching the leaf group can be facilitated.

Figure 12B:
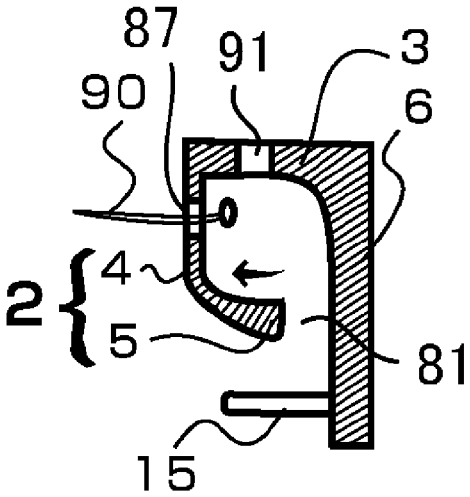

A file binder 106 exemplified in FIG. 12B is different from the file binders 101 to 105 in a point where the projecting member 3 is coupled to the upper end part of the back side plate member 2. The projecting member 3 formed in such a way also projects forward from the part of the back side plate member 2 higher than the lower end part 5 with no difference. In the example of FIG. 12B, through holes 87 for attaching the file binder 106 to the wall surface with nails 90 or the like are formed in a part of the main body part 4 of the back side plate member 2 between the projecting member 3 and the lower end part 5. In the example shown in FIG. 12B, through holes 91 are also formed in the projecting member 3. The through holes 91 can be used for example for hanging the file binder 106 onto the wall or the like by letting a string through the through holes. For example, both the pairs of through holes 87 and 91 are symmetrically formed. Further, in the example shown in FIG. 12B, the main body part 4 of the back side plate member 2 is formed to be thin, and thereby, the gap 81 can be easily extended with elastic restoring force.

Figure 12C:
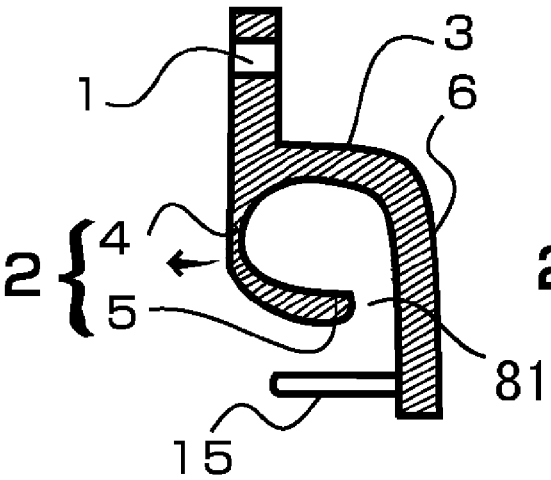

A file binder 105 exemplified in FIG. 12C is different from the already exemplified file binders 101 to 106 in a point where the projecting member 3 is curved. The projecting member 3 formed in such a way also projects forward from the back side plate member 2 with no difference. In the example shown in FIG. 12C, the front side plate member 6 is also slightly curved. The front side plate member 6 formed in such a way also extends downward from the front end part of the projecting member 3 with no difference.

Figure 12D:
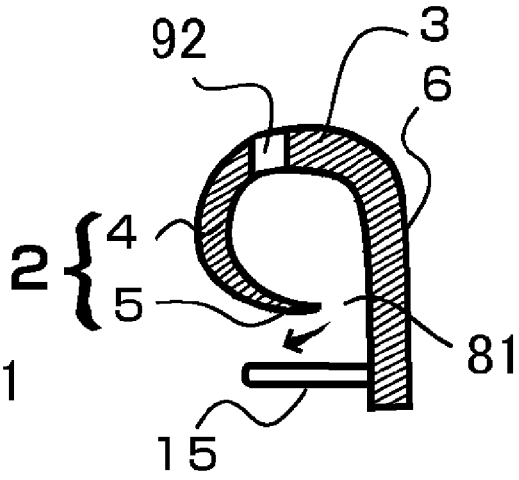

In a file binder 108 exemplified in FIG. 12D, not only the projecting member 3 but also the back side plate member 2 is curved. More specifically, the file binder is different from the already exemplified file binders 101 to 107 in a point where from the back side plate member 2 to the front side plate member 6 via the projecting member 3, the entire body is curved in a substantially circular shape in a section. In the file binder 108 formed in such a way, the lower end part 5 of the back side plate member 2 is also bent forward, the projecting member 3 also projects forward from the part of the back side plate member 2 higher than the lower end part 5, and the front side plate member 6 also extends downward from the front end part of the projecting member 3 with no difference. The mode exemplified in FIG. 12D is also within the scope of the present invention. In the example shown in FIG. 12D, through holes 92 are also formed in the projecting member 3 as well as the example of FIG. 12B. For example, the pair of through holes 92 is symmetrically formed.

FIG. 13 is a perspective front view of a file binder according to further another embodiment of the present invention. A file binder 109 exemplified in FIG. 13 is different from the file binders 101 to 108 in a point where the pillar shape protruding portions 15 protruding from the back surface of the front side plate member 6 are installable separate parts. In the example of FIG. 13, by screwing screws 95 into screw holes 94 passing through the front side plate member 6 in the back and forth direction, the pillar shape protruding portions 15 exemplified in FIG. 1 and the like are formed. In such a way, by making the pillar shape protruding portions 15 installable separate parts, a manufacturing process becomes easy and manufacturing cost can be further lowered in a case where the file binder 109 is formed by integrally molding resin.

As a configuration to make the pillar shape protruding portions 15 separate parts, a mode of pushing rivet-shaped and headed pillar shape bodies into through holes passing through the front side plate member 6 in the back and forth direction can be adopted. Alternatively, simple pillar shape bodies may be inserted into through holes passing through the front side plate member 6 in the back and forth direction or bottomed holes formed on the back surface of the front side plate member 6, and the pillar shape bodies may be secured to the front side plate member 6 with an adhesive. The present invention is not limited to the above examples but it is obvious for those skilled in the art that various modes can be adopted as the configuration to make the pillar shape protruding portions 15 separate parts.

In the file binders 101, 104, 109, the opening portion 9 is formed in part of the front side plate member 6. However, instead of forming the opening portion 9, at least part of the front side plate member 6 may be made of a transparent material. With this configuration, the user or the like can also see the printing done on the remaining part of paper 13 of the leaf group 201 or the like from the front side. It should be noted that the term "transparent" indicates such transparency that texts and the like can be visually recognized, and for example, a mode that the material is colored to the extent of not preventing visual recognition of texts and the like is included.

In the above description, the examples in which the file binder is used while hanging the leaf group 201, 202 or the like are shown as use of the file binder. However, the file binder 101, 102 or others is not limited to the use in which the leaf group 201, 202 or the like is hanged, but can be used for other purposes. For example, the leaf group 201, 202 or the like is placed on a desk or carried in a bag in a state where the leaf group is bound in the file binder 101, 102.

FIGS. 14A to 14E are illustrative views showing configurations of a file binder according to one embodiment of the present invention, and a printed matter according to one embodiment suitable for installment into the file binder. Some of the perspective views attached to the description are made under the rules of perspective. Expressions indicating the positions or the directions such as "front side", "back side", "front", "back", "upper", "lower", "left", "lower", and "horizontal" are based on a standard posture of a file binder 311 used while being attached to a wall surface in order to hang a leaf group installed as exemplified in FIG. 14D.

The file binder 311 has a front side plate member 313, a projecting member 315, and a back side plate member 317. The front side plate member 313, the projecting member 315, and the back side plate member 317 are for example formed by integrally molding plastic. The back side plate member 317 includes a main body part 318 and a lower end part 319 extending downward therefrom. The main body part 318 is formed in a flat plate shape so as to be along the wall surface to which the file binder is to be attached. The lower end part 319 is bent forward with respect to the main body part 318. In FIGS. 14B to 14D, the lower end part 319 is curved forward. However, the lower end part may be bent with an angle from the main body part 318 for example at 90 degrees. In any case, the lower end part 319 remains bent forward with respect to the main body part 318.

The projecting member 315 projecting forward is coupled to a part of the back side plate member 317, and the part lies on the upper side of the lower end part 319 and on the lower side of an upper end edge, for example, in the vicinity of center of the main body part 318. In the example of FIGS. 14B to 14D, the projecting member 315 is a plate shape body extending right and left. The front side plate member 313 extending downward is coupled to a front end part of the projecting member 315. In the example of FIGS. 14B to 14D, a main surface of the front side plate member 313 is parallel with a main surface of the main body part 318 of the back side plate member 317. In the example of FIGS. 14B to 14D, the projecting portion 315 not only couples the back side plate member 317 and the front side plate member 313 but also plays a role as a rib that provides rigidity against curve on a horizontal plane to the file binder 311.

The front side plate member 313 extends downward beyond a front end edge 320 of the lower end part 319 of the back side plate member 317, and forms a gap 322 from this front end edge 320. With this configuration, a bag shape space 349 is formed between the back side plate member 317 and the front side plate member 313.

In the file binder 311, pillar shape protruding portions 321 protruding backward from the back surface of the front side plate member 313 are formed. In the example of FIGS. 14B to 14D, two pillar shape protruding portions 321 are symmetrically formed to be placed side by side in the horizontal direction. The pillar shape protruding portions 321 are placed under a lowermost end of the back side plate member 317, and extend backward beyond the front end edge 320 of the lower end part 319 of the back side plate member 317. In the example of FIGS. 14B to 14D, the pillar shape protruding portions 321 reach onto the same plane as a back surface of the main body part 318 of the back side plate member 317. That is, the pillar shape protruding portions 321 are set to have such length that, when the back surface of the back side plate member 317 is abutted with the wall surface, tips are abutted with this wall surface or substantially abutted with the wall surface.

End edges of the back side plate member 317 on the lower side of the projecting member 315 and on the right and left sides when seen from the back side retreat to the center. This configuration is to facilitate a task of attaching the plurality of leaves to the file binder 311 to be described later with reference to FIG. 14B.

A through hole 325 passing through in the back and forth direction is formed in an upper end part of the back side plate member 317. By inserting a nail, a pushpin, a screw, a hook, or the like into this through hole 325, the file binder 311 can be easily attached to the wall surface. FIG. 14D exemplifies a mode in which other through holes 327 for letting a hanging string 329 through are further formed in the upper end part of the back side plate member 317. A groove intruding the projecting member 315 is formed in the back side plate member 317, and a magnet body 371 is embedded in the groove (refer to FIG. 14B). The magnet body 371 works to attract the file binder 311 to a magnetic body wall surface or the like with magnetic force.

FIGS. 14A, 14B exemplify a printed matter suitable for installment into the file binder 311. The printed matter 301 is formed as a daily calendar for each month. The printed matter 301 is formed by saddle-stitching thirty-two leaves at one side 303, and includes a leaf group on which daily tables of a calendar for a certain month of a year are successively printed. FIGS. 14A, 14B show an example in which the printed matter 301 is saddle-stitched by staples 309.

Two through holes 307 are formed along the one side 303 in the vicinity of the one side 303 in each leaf in the printed matter 301. The through holes 307 are formed at spots that substantially match between the stacked leaves. The through holes 307 are also formed at a position and with size with which the pillar shape protruding portions 321 can be inserted when an end part of the printed matter 301 on the side of the one side 303 is inserted into the gap 322 between the front side plate member 313 and the lower end part 319 of the back side plate member 317 of the file binder 311.

In each leaf in the printed matter 301, a cutout punched hole row 305 is formed along the one side at a position more distant from the one side 303 than the through holes 307. The punched hole row 305 is formed at a position that substantially matches between the stacked leaves. Further, the punched hole row 305 is formed at a position that matches a lowermost end edge of the front side plate member 313 when an end part of the printed matter 301 on the side of the one side 303 is inserted into the gap 322 of the file binder 311. The daily table is printed on a leaf major part 310 more distant from the one side 303 than the punched hole row 305.

As shown in FIG. 14B, by letting the printed matter 301 horizontally slide from one of the right and left end edges of the front side plate member 313 and the back side plate member 317 of the reversed file binder 311 to the other end edges, the printed matter can be installed into the file binder 311. In this process, an upper end part of the printed matter 301 is placed on the vicinity of one of right and left end parts of the front side plate member 313, the part being not covered by the back side plate member 317, and is slid to the other end part while curling the printed matter 301 in order to avoid contact with the pillar shape protruding portions 321. The end edges in the right and left direction of the back side plate member 317 on the lower side of the projecting portion 315 retreat to the center with respect to the corresponding end edges of the front side plate member 313. Thus, by once mounting the upper end part of the printed matter 301 onto the back surface of the front side plate member 313 and directly letting the upper end part slide, the printed matter 301 can be slipped into the gap 322 between the back side plate member 317 and the front side plate member 313 without difficulty.

When right and left positions of the printed matter 301 are set at predetermined final positions, by undoing the curl of the printed matter 301, the pillar shape protruding portions 321 are inserted into the through holes 307. As a result, as shown in FIG. 14C, by engaging the pillar shape protruding portions 321 with the through holes 307 of the printed matter 301, the printed matter 301 is held by the file binder 311. Since the pillar shape protruding portions 321 extend backward beyond the front end edge 320 of the lower end part 319 of the back side plate member 317 (refer to FIG. 14B), the printed matter 301 sagging from the gap 322 between the front end edge 320 and the front side plate member 313 is stably held by the pillar shape protruding portions 321.

The punched hole row 305 of the printed matter 301 is formed to be placed at a position corresponding to the lowermost end edge of the front side plate member 313 in a state where the printed matter 301 is installed into the file binder 311. Therefore, as shown in FIG. 14D, the leaf group of the printed matter 301 can be easily cut along the punched hole row 305 in order from the front side. Thereby, the user of the file binder 311 and the printed matter 301 can easily cut and remove the daily table of the previous day which is disused in each day. In such a way, the printed matter 301 held in a state where the printed matter is installed into the file binder 311 can be used as a wall daily calendar.

In the printed matter 301, by cutting and removing the daily table along the punched hole row 305 for each day, only an upper end part 308 of the printed matter ranging from the one side 303 to the punched hole row 305 is left at the end. The upper end part 308 of the printed matter 301 having no daily table can be easily removed from the file binder 311 by taking a procedure in the reversed order to the procedure of installing the printed matter 301 into the file binder 311. Thereby, the user can easily separate the disused upper end part 308 of the printed matter 301 from the file binder 311 and dispose as shown in FIG. 14E. The file binder 311 can be re-used for installment of a new printed matter 301 such as a printed matter 301 serving as a daily calendar of another month.

FIGS. 15 to 20 are process views exemplifying manufacturing methods of the printed matter according to other embodiments of the present invention. FIGS. 19A to 19E also exemplify a use method of the printed matter. As shown in FIGS. 19C to 19E, the printed matter 330 is formed as a monthly calendar. The printed matter 330 is formed by saddle-stitching sixteen leaves at one side, and includes a leaf group on which monthly tables of a calendar for a certain year, that is, a certain calendar year or fiscal year are successively printed. The two through holes 307 and the cutout punched hole row 305 are formed in each leaf in the printed matter 330 as well as each leaf in the printed matter 301 exemplified in FIGS. 14A, 14B. The monthly table is printed on the leaf major part 310 more distant from the one side serving as a center-folding reference line 331 than the punched hole row 305.

Figure 15A:
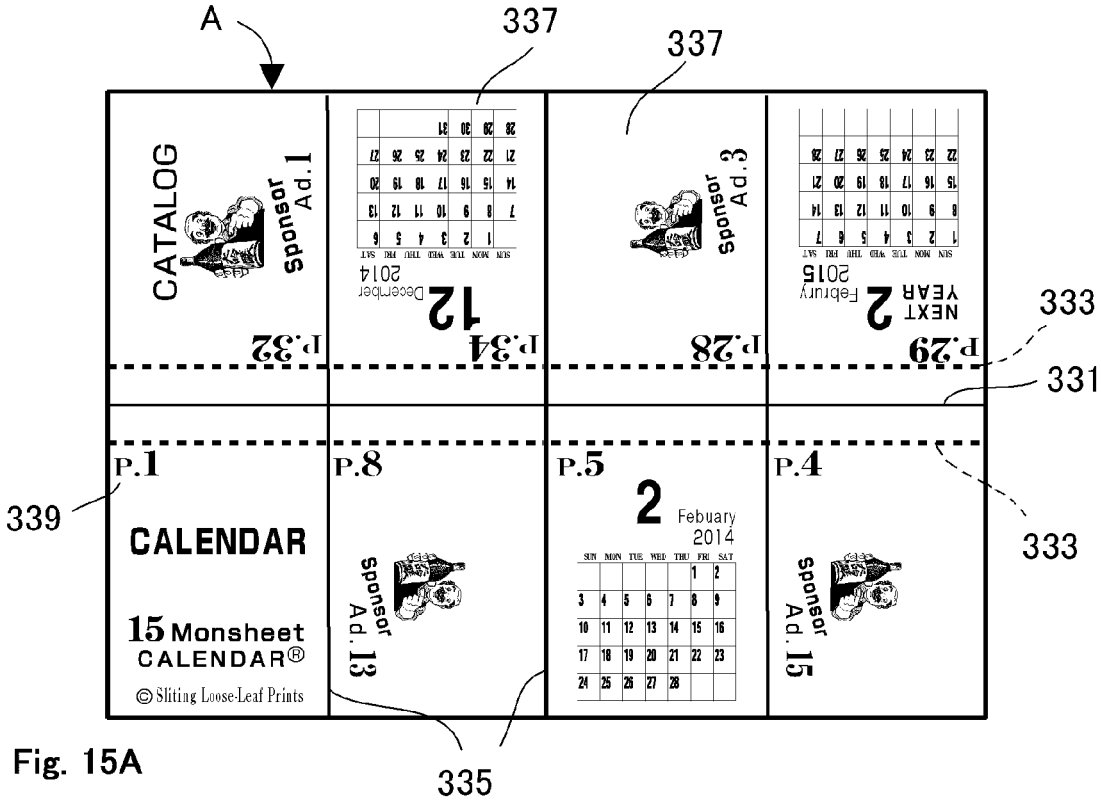
FIGS. 15A and 15B are process views exemplifying a manufacturing method of a printed matter according to another embodiment of the present invention.
Figure 15B:
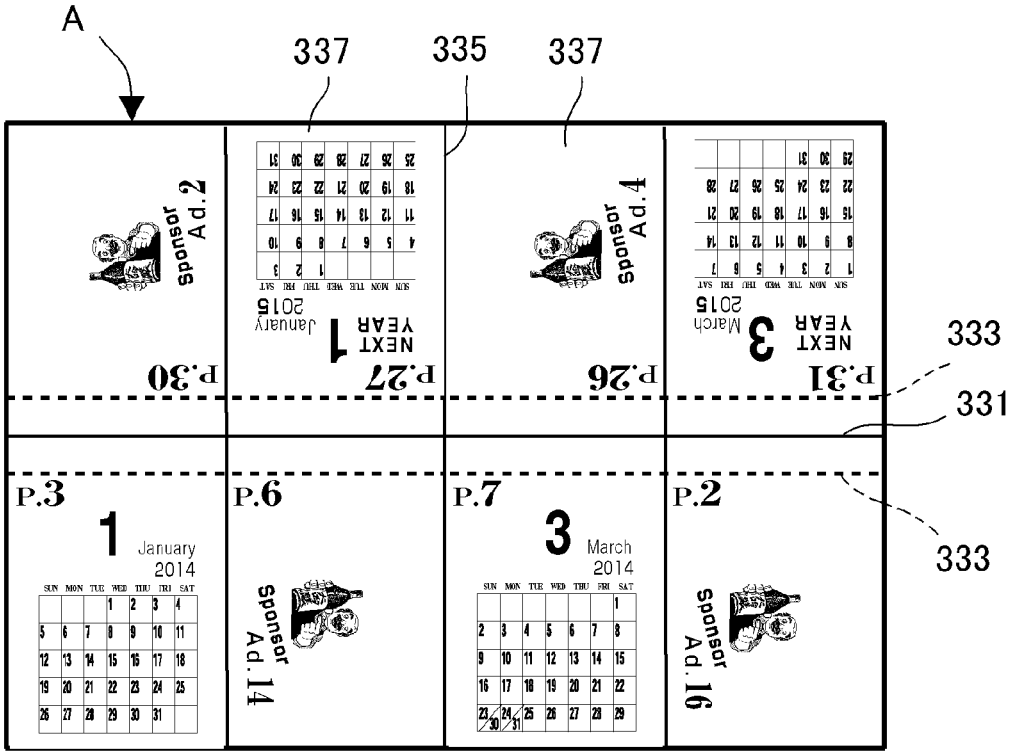

In order to manufacture the printed matter 30, firstly, as shown in FIGS. 15A, 15B and FIGS. 16A, 16B, two printing paper sheets A and B are prepared. The printing paper sheets A, B have A1 size as one example. FIGS. 15A and 15B respectively show the recto and the verso of the printing paper sheet A, and FIGS. 16A and 16B respectively show the recto and the verso of the printing paper sheet B. Each of the printing paper sheets A, B is divided into two by the center-folding reference line (binding spine line) 331, and further equally divided into eight regions (signatures) 337 by signature lines 335. Each of the regions 337 has A4 size as one example. That is, the printing paper sheets A, B are supposed to be folded into an octavo.

Figure 16A:
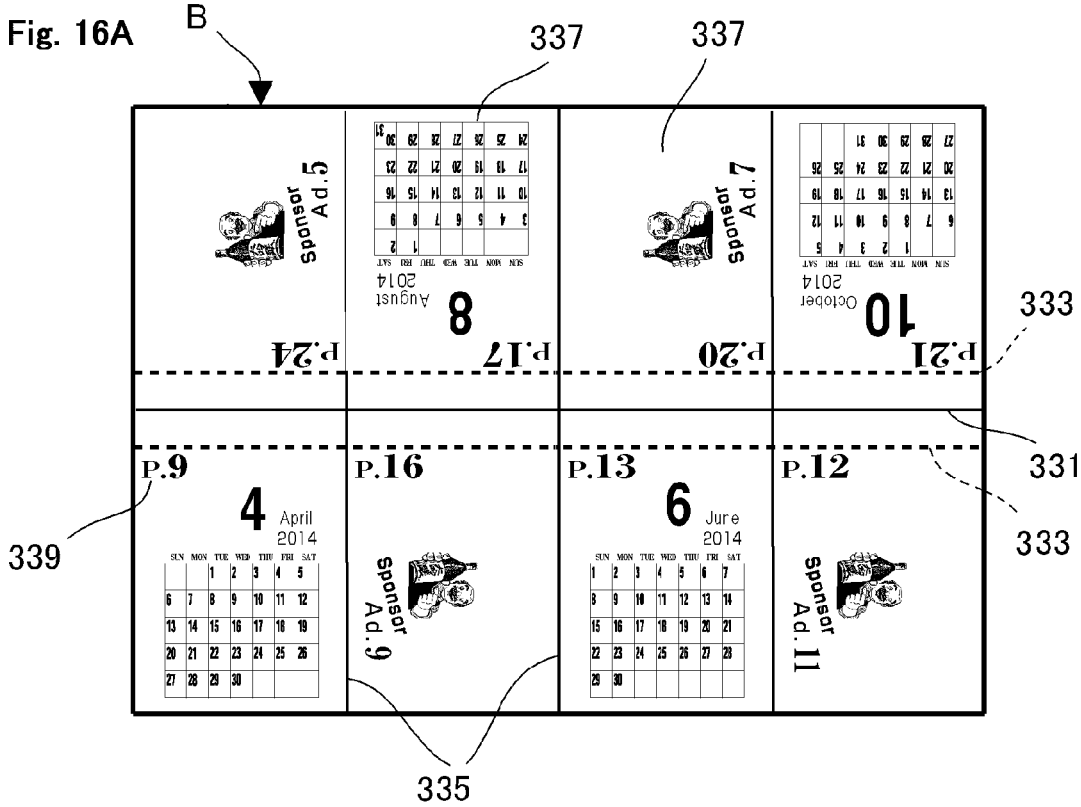
FIGS. 16A and 16B are process views exemplifying a manufacturing method of the printed matter according to the another embodiment of the present invention.
Figure 16B:
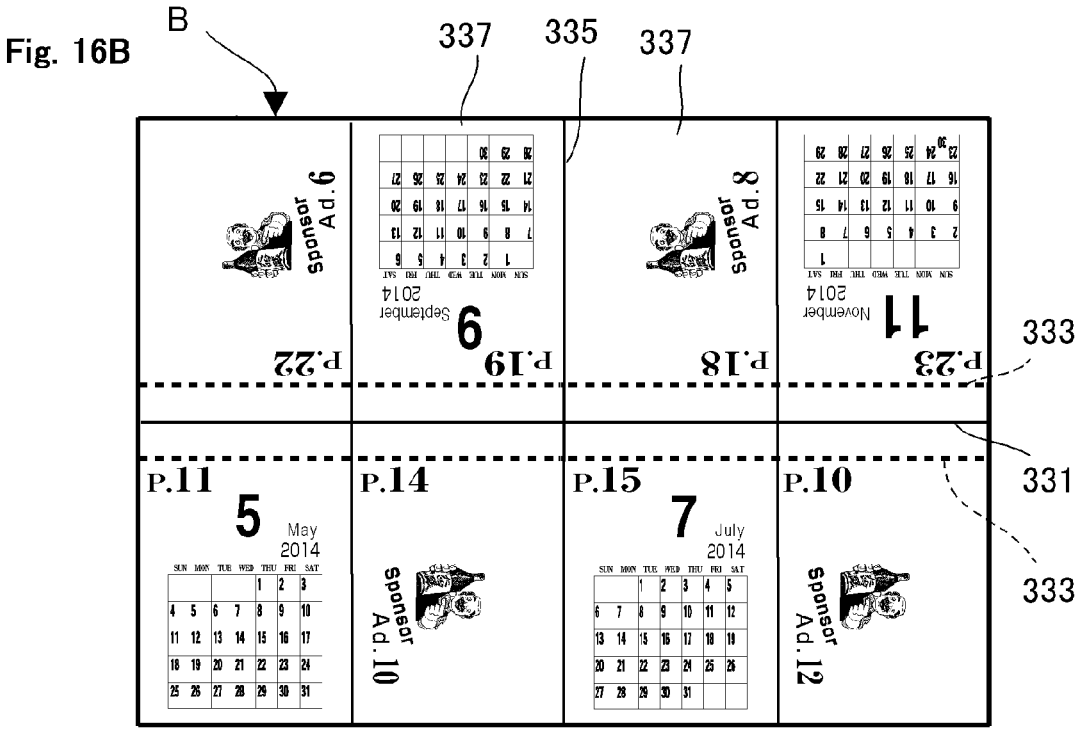

Printing is done on the recto and the verso of the printing paper sheets A, B. The printing may be the sheet printing or the rotary printing. Upon the sheet printing, after the printing paper sheets A, B for example having A1 size are prepared, the printing exemplified in FIGS. 15A, 15B or FIGS. 16A, 16B is performed for each of the printing paper sheets A, B. Upon the rotary printing, the printing exemplified in FIGS. 15A, 15B or FIGS. 16A, 16B is performed on a roll shape sheet. The printing exemplified in FIGS. 15A, 15B and the printing exemplified in FIGS. 16A, 16B are done on separate roll shape sheets for efficiency. By cutting into for example A1 size after printing, the roll shape sheet becomes the printing paper sheet A exemplified in FIGS. 15A, 15B or the printing paper sheet B exemplified in FIGS. 16A, 16B.

In a process of printing, cutout punched hole rows 333 are formed on both sides of the binding spine line 331 at an equal distance. Upon either the sheet printing or the rotary printing, the punched hole rows 333 can be formed in a form of adding to the printing process. Upon the sheet printing, the punched hole rows 333 can be formed in each of the printing paper sheets A, B on which the printing is to be done by a so-called "Thomson" device. Upon the rotary printing, by preparing a drum for forming the punched hole row in line with four printing drums corresponding to four colors, the punched hole rows 333 can be formed in the roll shape sheet.

The punched hole rows 333 are formed in the vicinity of the binding spine line 331 in parallel with the binding spine line 331. A distance from the binding spine line 331 to the punched hole row 333 is set to be shorter in the printing paper sheet B than in the printing paper sheet A. As a preferable example, in the printing paper sheets A, B supposed to be folded in an octavo, the difference is set to be four times more than thickness of the printing paper sheets A, B.

The printing is done on a major region more distant from the binding spine line 331 than the punched hole rows 333. As one example, a page number 339 is printed on each of the signatures 337. In the printed matter 330 after completion of saddle-stitching, for example, an odd-numbered page is the recto, and an even-numbered page is the verso. In the signatures 337, a front page of the calendar or a monthly table is printed on the odd-numbered page, and a printed matter in a different category from that of the odd-numbered page such as an advertisement or a catalog is printed on the even-numbered page.

Figure 17A:
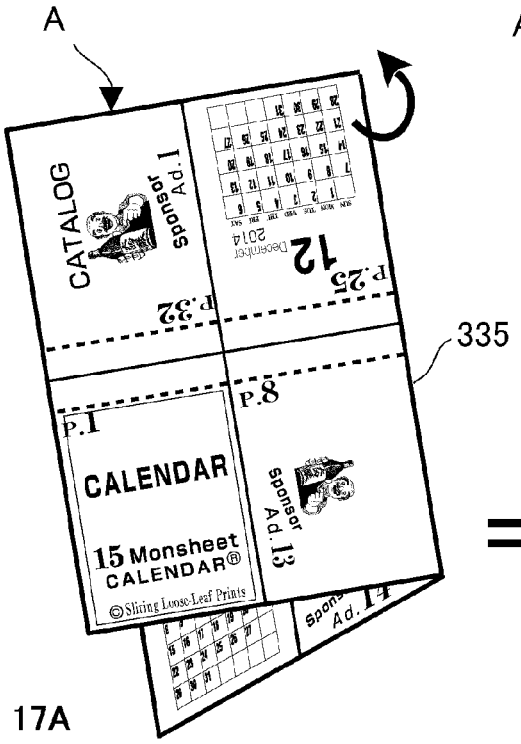
FIGS. 17A to 17D are process views exemplifying a manufacturing method of the printed matter according to the another embodiment of the present invention.
Figure 17B:
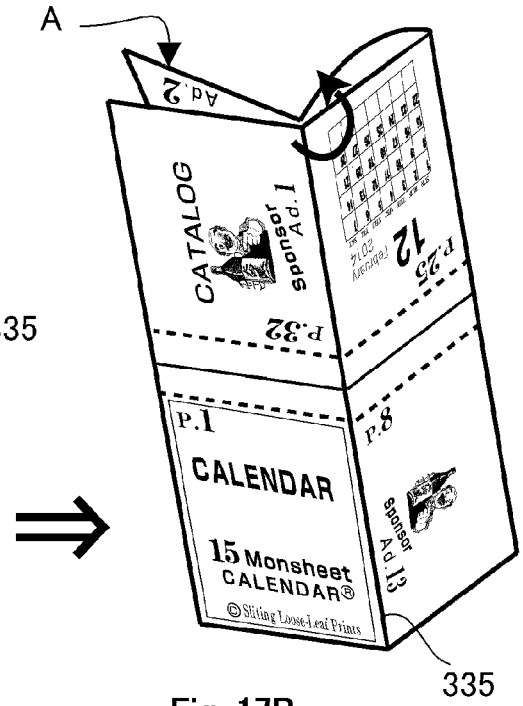
Figure 17C:
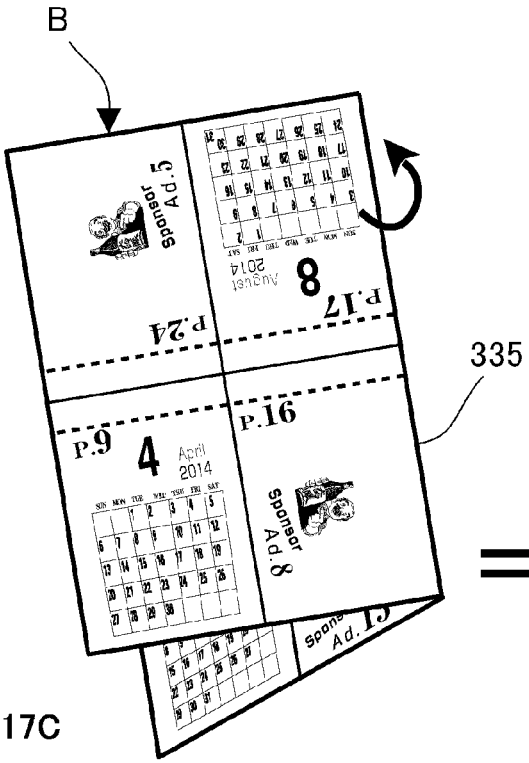
Figure 17D:
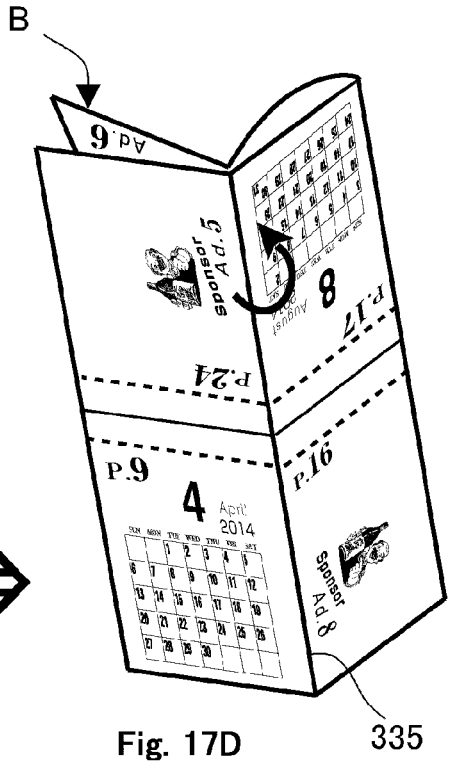

Next, as shown in FIGS. 17A, 17B, the printing paper sheets A, B are respectively folded twice along the three signature lines 335. Further, as shown in FIGS. 18A to 18D, the printing paper sheets A, B are respectively center-folded along the binding spine lines 331. Successively, as shown in FIGS. 18E to 18G, the center-folded printing paper sheets A, B are stacked in such a manner that the binding spine lines 331 overlie each other and the printing paper sheet B is nested inside. After that, as shown in FIG. 18H, the printing paper sheets A, B are saddle-stitched by the staples 309 along the binding spine line 331 serving as a part to be folded.

Figures 19A, 19B, 19C, 19D, 19E:
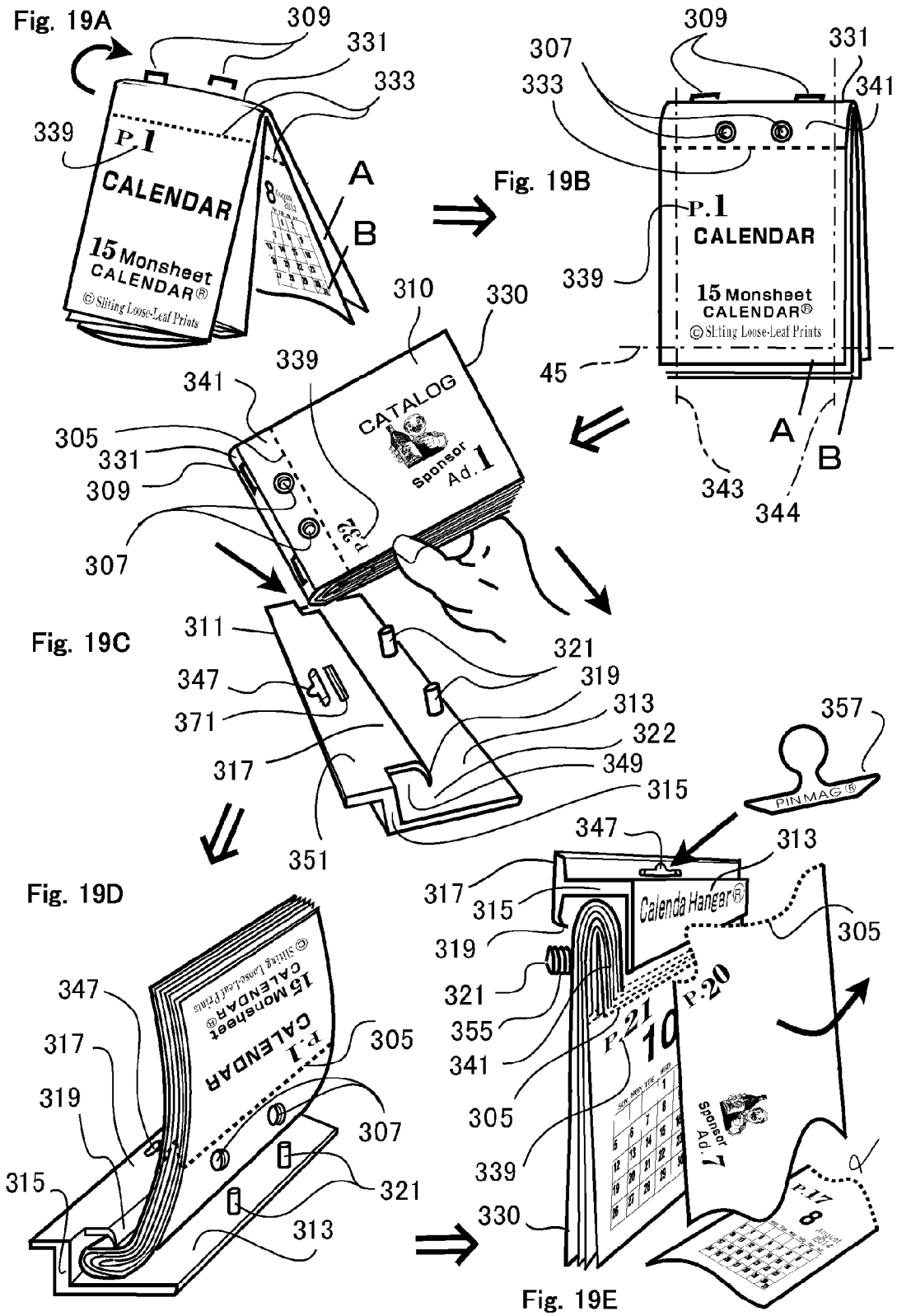
FIGS. 19A to 19E are process views exemplifying a manufacturing method of the printed matter according to the another embodiment of the present invention, and a use method.

Next, three sides of the printing paper sheets A, B already saddle-stitched as shown in FIG. 19A are cut as shown in FIG. 19B. That is, the three sides other than one side along the binding spine line 331 of the already saddle-stitched printing paper sheets A, B are cut along cut lines 343, 344, 345. In tandem, the through holes 307 are formed in an upper end part 341 of the saddle-stitched printing paper sheets A, B serving as a region between the binding spine line 331 and the punched hole rows 333 in parallel with the binding spine line 331. Thereby, as shown in FIG. 19C, the printing paper sheets A, B become the printed matter 330. The punched hole rows 333 continuing in each of the printing paper sheets A, B become the punched hole row 305 for each of the bound leaves.

The printed matter 330 is installed into a file binder 351 formed as the same as the file binder 311 shown in FIGS. 14A to 14E. As shown in FIGS. 19C, 19D, a procedure of installment is the same as the procedure of installment of the printed matter 301 shown with reference to FIGS. 14B to 14D.

The file binder 351 has a through hole 347 formed in the upper end part of the back side plate member 317 and passing through in the back and forth direction. The through hole 347 has a long hole extending right and left and a cut going toward the upper end side in a center part thereof. The cut is suitable for hanging the file binder 351 onto a nail, a hook, or the like protruding from the wall surface or the like. The long hole is formed in the same way as an opening portion of a magnet holding base disclosed in Patent Document 3, and detachably holds a magnet body 357 of a particular shape disclosed in Patent Document 3 (FIG. 19E). By installing the magnet body 357 into the long hole of the through hole 347, the magnetic force of the embedded magnet 371 is reinforced, so that a heavier printed matter can be installed into the file binder 351. As shown in FIG. 19E, concave and convex parts repeating in the axial direction such as a thread may be formed on side surfaces of the pillar shape protruding portions 321. Thereby, the printed matter 330 installed into the file binder 351 less easily drops off the pillar shape protruding portions 321.

As shown in FIG. 19E, the punched hole row 305 of the printed matter 330 is formed to be placed at the position corresponding to the lowermost end edge of the front side plate member 313 in a state where the printed matter 330 is installed into the file binder 351. In particular, as shown in FIGS. 20A, 20B, a distance from the binding spine line 331 to the punched hole row 305 is set to be shorter in the printing paper sheet B placed on the inner side than in the printing paper sheet A placed on the outer side. The difference corresponds to four times more than the thickness of the printing paper sheets A, B. Therefore, as shown in FIGS. 20C, 20D, the punched hole rows 305 are placed at the substantially same positions between the printing paper sheets A, B. FIG. 20D indicates the upper end part 341 of the printed matter 330 to be left after cutting the leaf group of the printed matter 330 along the punched hole rows 305.

Between the leaves in the leaf group of the printed matter 330, the punched hole rows 305 only need to be placed at positions that practically, that is, substantially match with each other, allowing slight displacement. Similarly, regarding a positional relationship between the punched hole rows 305 of the leaf group and the lowermost end edge of the front side plate member 313, the punched hole rows and the lowermost end edge only need to be placed at the practically, that is, substantially same positions.

As shown in FIG. 19E, in the printed matter 330 installed into the file binder 351, the leaves in the leaf group can be easily cut along the punched hole row 305 in order from the front side. Thereby, the user of the file binder 351 and the printed matter 330 can easily cut and remove the monthly table of the previous month which is disused in each month. In such a way, the printed matter 330 held in a state where the printed matter is installed into the file binder 351 can be used as a wall monthly calendar.

The example in which the two printing paper sheets A, B are respectively folded in an octavo in order to manufacture the printed matter 330 formed by binding the sixteen leaves has been shown. However, other methods such as a method of respectively folding four printing paper sheets into a quarto and a method of respectively folding eight printing paper sheets into a folio can also be adopted. Upon a folio folding, since one printing paper sheet is only center-folded along the binding spine line 331, the one binding spine line 331 is not broken in the middle but remains one. In order to manufacture the printed matter 301 formed by binding thirty-two leaves, various methods such as a method of respectively folding two printing paper sheets into a sixteenmo, a method of respectively folding four printing paper sheets into an octavo, and a method of respectively folding eight printing paper sheets into a quarto can be adopted. When a sixteenmo folding is adopted, the punched hole rows 333 may be formed on both sides of each of the two binding spine lines 331 in the printing paper sheet. The printing paper sheet is folded in such a manner that the two binding spine lines 331 completely overlie each other.

FIG. 21 is an illustrative view showing a configuration of a printed matter according to still another embodiment of the present invention, and a use method. This printed matter 340 has the printed matter 330, and another leaf 350 to be added to this. The leaf 350 is not bound together with the leaf group of the printed matter 330. The leaf 350 is installed into the file binder 351 together with the printed mater 330 in a state where the leaf is inserted between the leaves in the leaf group of the printed matter 330 or stacked on the leaf group. Therefore, the leaf 350 is formed in such a manner that an outline thereof substantially overlies an outline of the leaf group of the printed matter 330, and the through holes 307 and the punched hole row 305 thereof also substantially overlie the through holes and the punched hole row of the leaf group. The leaf 350 may be supplied to the user together with the printed matter 330 in a mode in which the leaf is inserted between the leaves in the leaf group of the printed matter 330 or stacked on the leaf group, or may be supplied to the user in a mode in which the leaf is not yet inserted or stacked in order to let the user operate. The leaf 350 can be utilized as an inserted flier or utilized for supplying a corrected version of a printed content in some leaf in the printed matter 330.

Figure 22A:
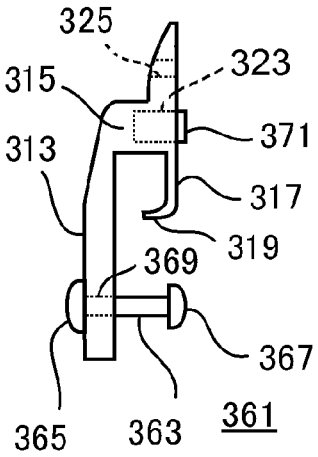
FIGS. 22A to 22D are illustrative views showing a configuration of a file binder according to moreover another embodiment of the present invention, and a use method.

FIGS. 22A to 22D are illustrative views showing a configuration of a file binder according to moreover another embodiment of the present invention, and a use method. As shown in FIG. 22A, in this file binder 361, as one example, two pillar shape protruding portions 363 pass through the front side plate member 313 and are movable with respect to the front side plate member 313. Through holes 369 into which the pillar shape protruding portions 363 are inserted are formed in the front side plate member 313. A leaf stopping member 367 having a step wall is formed in a back end part of each of the pillar shape protruding portions 363 in such a manner that the leaves of the installed printed matter 330 or the like less easily drop off. A retaining member 365 having a step wall is formed in a front end part of each of the pillar shape protruding portions 363 in order to prevent the pillar shape protruding portion 363 from dropping off the front side plate member 313.

Preferably, the file binder 361 is formed by insert molding of plastic in such a manner that the pillar shape protruding portions 363 pass through the front side plate member 313. Thereby, the pillar shape protruding portions 363 receive appropriate frictional force from the through holes 369 to such an extent that the pillar shape protruding portions are movable in the back and forth direction by finger pressure of a human being.

Figure 22C:
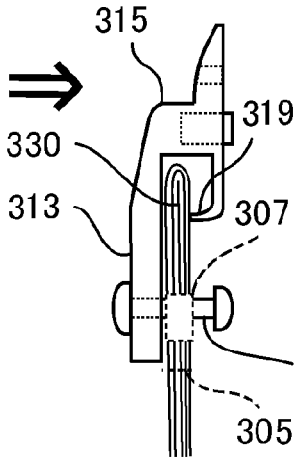
Figure 22D:
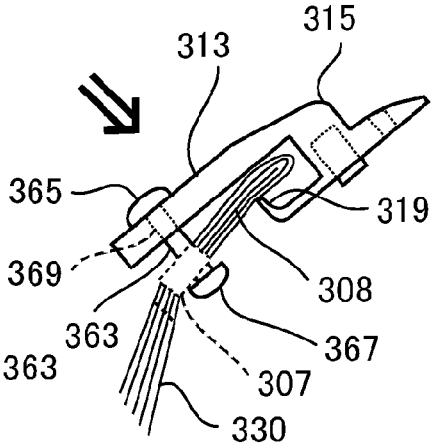
Figure 22B:
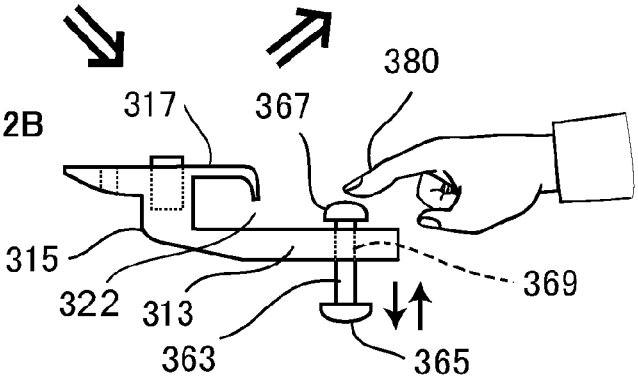

In order to install the printed matter 330 into the file binder 361, firstly, as shown in FIG. 22B, the pillar shape protruding portions 363 are moved as far forward as possible with respect to the front side plate member 313 by finger pressure. Thereby, without curling the printed matter 330, an upper end part of the printed matter can be inserted into the gap 322 between the back side plate member 317 and the front side plate member 313 from the lower side. After the printed matter 330 is arranged at a predetermined position, by pushing the retaining members 365 by finger pressure, the pillar shape protruding portions 363 are moved backward and inserted into the through holes 307 of the printed matter 330. Thereby, as shown in FIG. 22C, the printed matter 330 is installed into the file binder 361. As shown in FIG. 22D, even when the file binder 361 into which the printed matter 330 is installed is inclined in any posture, the printed matter 330 is locked by the stopping members 367 and hence less easily drops off the pillar shape protruding portions 363. It should be noted that FIGS. 22C, 22D show the through hole 307 as a rectangular region defined by a dotted line so that a position and a sectional shape of the through hole are easily understood.

In addition to the embodiments shown above, various modified modes can be adopted in the present invention. For example, the mode of the saddle-stitched printed matter is exemplified as the printed matter 301, 330. However, the through holes 307 and the punched hole rows 305 may be formed in a non-wire stitched printed matter bound by glue or the like. Further, the stopping members 367 may be formed in the tip parts of the pillar shape protruding portions 321 (FIG. 14B) fixed to the front side plate member 313, as the tip parts of the pillar shape protruding portions 363 (FIG. 22A). Thereby, the installed printed matter 301 less easily drops off the pillar shape protruding portions 321. Instead of forming the stopping members 367 or the retaining members 365 to have steps over the entire circumference of the pillar shape protruding portions 363 as exemplified in FIG. 22A, the members may be formed in a shape having steps only in a certain part of the entire circumference such as an upper part, for example in a hook shape. In this case, in a case where the pillar shape protruding portions 363 are movable with respect to the front side plate member 313 as exemplified in FIG. 22A, in order to regulate circumferential rotation of the pillar shape protruding portions 363, for example, sections of the pillar shape protruding portions 363 are desirably formed in a non-circular shape.

The present application is based on Japanese Patent Application No. 2013-023912 filed to Japan by the present applicant in Feb. 9, 2013 and Japanese Patent Application No. 2013-126285 filed to Japan by the present applicant in Jun. 17, 2013, and all the contents thereof are incorporated herein by reference.

The above description regarding the particular embodiments of the present invention is provided for the purpose of exemplification. Those do not intend to be all-inclusive or to limit the present invention to the described modes. It is obvious for those skilled in the art that a large number of modifications and changes can be made under the contents described above.

DESCRIPTION OF REFERENCE SIGNS

1: Through hole
2: Back side plate member
3: Projecting member
4: Main body part
5: Lower end part
6: Front side plate member
7: Bag shape space
8: Retreating end edge
9: Opening portion
10: Folding back bound margin
11: Folding perforation
12: Cutout perforation
13: Remaining part of paper
14: Fastening fitting
15: Pillar shape protruding portion
16: Through hole
20: Printing (advertisement)
50: Monthly table
60: Daily table
70: String
71: Through hole
80: Front end edge
81: Gap
83: Coupled part
85: Lowermost end edge
87: Through hole
101 to 109: File binder
201 to 204: Leaf group, leaf (leaves) of paper
301, 330, 340: Printed matter
303: One side
305, 333: Punched hole row
307: Through hole
308, 341: Upper end part of printed matter
311, 351, 361: File binder
313: Front side plate member
315: Projecting member
317: Back side plate member
319: Lower end part
320: Front end edge
321, 363: Pillar shape protruding portion
322: Gap
331: Binding spine line (reference line)
335: Signature line
A, B: Printing paper sheet (printing sheet)
350: Another leaf
367: Stopping member
365: Retaining member
371: Magnet body

What is claimed is:

1. A file binder comprising:

a back side plate member whose lower end part is bent forward;

a projecting member projecting forward from a part of the back side plate member higher than the lower end part;

a front side plate member extending downward from a front end part of the projecting member; and at least one pillar shape protruding portion protruding backward from a back surface of the front side plate member, wherein the front side plate member further extends downward beyond a front end edge of the lower end part of the back side plate member, and forms a gap from the front end edge, and the at least one pillar shape protruding portion is placed lower than a lowermost end of the back side plate member, and extends backward beyond the front end edge of the back side plate member.

2. The file binder according to claim 1, wherein the at least one pillar shape protruding portion protrudes by such length that, when the back side plate member is abutted with a wall surface, a tip is substantially abutted with the wall surface.

3. The file binder according to claim 1, wherein at least one of right and left end edges of the back side plate member retreats to a center side with respect to a corresponding one of right and left end edges of the front side plate member.

4. The file binder according to claim 1, wherein an opening portion is formed in part of the front side plate member.

5. The file binder according to claim 1, wherein at least part of the front side plate member is transparent.

6. The file binder according to claim 1, wherein a through hole passing through a part of the back side plate member higher than the projecting member in a back and forth direction is formed.

7. The file binder according to claim 1, wherein the at least one pillar shape protruding portion has, at a tip part, a leaf stopping member having a step wall.

8. The file binder according to claim 7, wherein the at least one pillar shape protruding portion passes through the front side plate member, is movable back and forth with respect to the front side plate member by finger pressure of a human being, and has, at another tip part protruding forward from the front side plate member, a retaining member having a step wall.

9. A printed matter set comprising:

the file binder according to claim 1; and a plurality of leaves installable into the file binder and having printing done on each of the leaves, wherein a through hole is formed at least one spot in one end part of each of the plurality of leaves, the at least one spot corresponding to the at least one pillar shape protruding portion of the file binder when the plurality of leaves are installed into the file binder, and cutout perforations are further formed at a position of the one end part of each of the plurality of leaves, the position corresponding to a lowermost end edge of the front side plate member of the file binder when the plurality of leaves are installed into the file binder.

* * * * *